US011090214B2

(12) United States Patent
Romano et al.

(10) Patent No.: US 11,090,214 B2
(45) Date of Patent: Aug. 17, 2021

(54) LEG SUPPORT ASSEMBLY FOR MEDICAL EXAMINATION DEVICE

(71) Applicant: United Metal Fabricators, Inc., Johnstown, PA (US)

(72) Inventors: Joseph Romano, Johnstown, PA (US); Quinn Carpenter, Johnstown, PA (US); Roelof deVries, Somerset, PA (US)

(73) Assignee: United Metal Fabricators, Inc., Johnstown, PA (US)

( * ) Notice: Subject to any disclaimer, the term of this patent is extended or adjusted under 35 U.S.C. 154(b) by 270 days.

(21) Appl. No.: 16/056,108

(22) Filed: Aug. 6, 2018

(65) Prior Publication Data

US 2020/0038275 A1 Feb. 6, 2020

(51) Int. Cl.
*A61G 13/12* (2006.01)
*A61G 13/02* (2006.01)

(52) U.S. Cl.
CPC ..... *A61G 13/1245* (2013.01); *A61G 13/02* (2013.01)

(58) Field of Classification Search
CPC ..... A61G 13/1245; A61G 13/02; A61G 13/1235; A61G 13/123; A61G 13/12; A61G 13/08; A61G 7/1096; A61G 7/0755; A61G 7/109; A61G 7/075; A61G 17/163; A61G 13/0009; A61G 13/0018; A61G 7/015; A47C 20/021; A47B 88/41; A47B 21/0314; A47B 21/0335; A47B 2021/0321; A47B 2021/0342; A47B 23/00

See application file for complete search history.

(56) References Cited

U.S. PATENT DOCUMENTS

| | | | |
|---|---|---|---|
| 1,262,216 | A | 4/1918 | Lee |
| 2,712,484 | A | 7/1955 | Adolphson |
| 4,034,972 | A | 7/1977 | Peterson |
| 4,376,317 | A | 3/1983 | Johnston |
| 4,409,695 | A | 10/1983 | Johnston et al. |
| 4,508,387 | A | 4/1985 | Gilbert et al. |
| 4,632,449 | A | 12/1986 | Masuda |
| 4,709,972 | A | 12/1987 | LaBudde et al. |
| 5,025,802 | A | 6/1991 | Lalco |
| 5,052,378 | A | 10/1991 | Chitwood |

(Continued)

FOREIGN PATENT DOCUMENTS

EP 1116654 B1 6/2005

*Primary Examiner* — Robert G Santos
*Assistant Examiner* — Alison N Labarge
(74) *Attorney, Agent, or Firm* — Metz Lewis Brodman Must O'Keefe LLC

(57) ABSTRACT

A leg support assembly for a medical examination device having tracks, a frame and a leg pad. The frame is configured so the leg pad mounted thereto is angled relative to the horizontal in a stowed position within the examination device. Guide members are movable along the tracks to maneuver the leg pad between stowed and deployed positions. The tracks include a horizontal section for forward movement, an incline section enabling elevation, and a detent to retain the leg pad in a deployed position. When deployed, the upper surface of the leg pad is level or co-planar with the seat cushion of the examination device. Greater vertical displacement of the leg pad is achieved than the vertical height of the leg support assembly when stowed.

28 Claims, 16 Drawing Sheets

(56) References Cited

U.S. PATENT DOCUMENTS 5,098,053 A * 3/1992 Cotterill ..... A47B 21/0314 108/6
5,302,015 A * 4/1994 Du Vall ..... A47B 21/0314 248/286.1
6,209,463 B1 4/2001 Koharchik et al.
6,295,987 B1 10/2001 Parker et al.
6,412,126 B2 * 7/2002 Heimbrock ..... A61G 7/0507 5/600
6,568,008 B2 5/2003 Siepmann et al.
6,926,366 B2 8/2005 Wolters
7,350,249 B2 4/2008 Jacobs et al.
7,512,998 B2 4/2009 Martin et al.
7,640,608 B2 1/2010 Smith et al.
7,665,166 B2 2/2010 Martin et al.
7,669,259 B2 3/2010 Ganance et al.
7,774,873 B2 8/2010 Martin et al.
7,845,003 B2 11/2010 Morris et al.
RE43,532 E 7/2012 Menkedick et al.
8,231,190 B2 7/2012 Ertz et al.
8,408,666 B2 4/2013 Armstrong et al.
8,651,591 B1 2/2014 Chen et al.
8,727,457 B2 5/2014 Marshall et al.
9,038,216 B2 * 5/2015 Buege ..... A61G 13/06 5/611
9,950,673 B2 * 4/2018 Granzotto ..... A47B 88/402
2002/0108178 A1 8/2002 Francois
2002/0170116 A1 * 11/2002 Borders ..... A61G 12/002 5/600
2003/0001464 A1 * 1/2003 Kelley ..... A47B 21/0314 312/208.1
2004/0068797 A1 * 4/2004 Smith ..... A61G 13/06 5/617
2005/0151408 A1 7/2005 Pratte et al.
2010/0201169 A1 8/2010 Fox et al.
2015/0342805 A1 12/2015 Harris, Jr.
2018/0221229 A1 * 8/2018 Kaiser ..... A61G 13/1245

* cited by examiner

LEG SUPPORT ASSEMBLY FOR MEDICAL EXAMINATION DEVICE

FIELD OF THE INVENTION

This invention relates to medical examination devices such as tables and chairs, and more particularly, to leg and arm support assemblies for use on medical examination tables and chairs to improve examination effectiveness and patient comfort during examinations.

BACKGROUND

Medical examination devices, such as tables and procedure chairs, are commonly used in the medical industry to examine and treat patients in a seated or lying position. These devices are adjustable in the vertical direction to allow patients to get onto and off the device but bring the patient to the height the medical professional needs for the examination or treatment. The back is also adjustable to move from a seated position to a horizontal position allowing the patient to lie down. Often these adjustments are made once the patient is already on the table and may be made during the course of the examination or treatment. Medical examination tables also include a number of drawers, trays, pans, stirrups and other accessories that are stowed within the table, such as in a cavity underneath the seat cushion where the patient sits or lies. The drawers, trays and pans may hold supplies or instruments or may be used to collect fluids or other material that may run off the table during the examination or treatment. These accessories are stored flush with the front of the table so they do not obstruct the patient's legs hanging down from the table. However, they are still readily accessible so they may be pulled out of storage and used during the examination or treatment. Often the accessories are accessible from the front end of the table.

Once a patient is positioned lying back in a supine orientation, their legs extend past the edge of the table. Many medical examination tables have leg pads that are stowed in the table and extend horizontally out from the table to support the patient's legs. However, these leg pads are positioned lower than the body of the patient. This creates uncomfortable strain on the patient's lower back, hips and legs during the examination or treatment. It may also increase fluid flow to the legs, causing discomfort and swelling. It may also interfere with a clinician's ability to accurately perform an exam when the supine position is optimal for the patient. It is not a natural position in which to lie and so is generally uncomfortable or awkward for the patient. It would therefore be beneficial to have a way to support the patient's legs during an examination or treatment that is comfortable for the patient and a natural position.

Many medical examination devices such as tables and chairs have leg pads that are stowed in a vertical position along the base of the table and are rotated upward for deployment. However, this covers a substantial portion of the front end of the device, greatly limiting the use of pans, drawers and other accessories with the table or chair. It would therefore also be beneficial to have a medical examination device with leg support level with the device that permits the storage and use of drawers, pans, trays, and other accessories commonly found in medical examination tables.

Many medical examination devices such as tables and chairs also lack any form of arm support for the patient. This can be problematic, leaving the patient to support themselves using only the table top or their own lap. Having an armrest is preferable for patients who may have to spend an extended period of time on the examination table, such as during or recovering from a procedure, or even just adjusting their positioning on the table. Procedure chairs, also used in the medical profession for examination and performing procedures, may include armrests that may be pivoted up and back to allow the patient access to and from the chair. While these provide some arm support, they are often not adjustable and provide only one deployed position in a seated position. Patients who are taller or shorter may find the positioning uncomfortable.

Furthermore, patients may have their blood pressure taken at the beginning of an examination or procedure, such as in collecting basic vital signs for patient records. This blood pressure reading is commonly taken while the patient is sitting before getting onto a medical examination device such as a table or chair since blood pressure readings should be taken when a patient is sitting with their feet placed firmly on a supporting surface such as the floor. More accurate readings are obtained when the patient's arm is raised so the bicep is level with or elevated above the heart, but this is an unnatural position that is awkward and may be difficult for a patient to maintain for the length of time needed to obtain an accurate blood pressure reading. In the medical industry, it is common to therefor rely on the substandard option of taking the blood pressure reading with the arm hanging down in a natural position with the hand on the lap or an armrest of a chair. Supporting the arm on an armrest of the table, bed or chair provides sufficient support for patient comfort, but sacrifices accuracy in the reading. Some have recently sought to address this problem by providing armrest covers that are adjustable into different angles, but these are separate from the armrest themselves and are subject to collapse when weight is applied. They do not provide sufficient support for a patient's arm.

It would therefore be beneficial to have an arm support that can comfortably and reliably support a patient's arm, and preferably may support the arm while taking blood pressure readings.

SUMMARY

The present invention addresses these concerns in a number of ways. For instance, a leg support assembly is configured to fit entirely within the cavity of a medical examination device, such as a table, for storage and may be pulled out for use. When deployed, the leg pad is brought out and up, bringing the leg pad level or co-planar with the seat cushion of the medical examination device. Therefore, with the seat back articulated downward so a patient can lay down, the leg support is ideally positioned level with the seat cushion for patient comfort, despite starting from a position below the level of the seat.

To accomplish this, the leg support assembly includes a track(s) that have a horizontal section, inclined section and detent. Guide members, such as pins or rollers, contacting the track(s) are moved from the horizontal section to the inclined section as the frame of the leg support assembly is pulled forward. As the first guide members contact the inclined section of track, the frame of the leg support assembly and the attached leg pad begin to elevate. At the top of the inclined section there is a detent into which the first guide member sits in the deployed position. Before dropping or otherwise positioning the frame so the first guide member enters the detent, the leg pad is slightly above the level of the seat cushion. Once the first guide member is retained within the detent, the leg pad is brought level with the seat cushion. A second guide member at the rear of the track remains within the horizontal section throughout the deployment process and in both the stowed and deployed positions.

The frame that is movably attached to the tracks through the guide members is further configured to support the leg pad at an angle relative to the horizontal section of track. Accordingly, the leg pad is angled in a forward direction when stowed in the cavity of medical examination device. Rather than remaining at this downward angle once deployed, however, the configuration of the tracks changes the angle of presentation of the leg pad so that its upper surface is level or co-planar with at least the portion of the seat cushion on which the patient sits. This combination of the tracks, guide members and angle of leg pad mounting not only changes the presentation angle of the leg pad during deployment, but also achieves a greater vertical displacement of the leg pad between the stowed and deployed positions than the vertical space taken up by the leg support assembly within cavity of the medical examination device. This leg support assembly therefore minimizes space taken up in the cavity while maximizing the elevation achievable by the leg pad upon deployment and avoiding interference with other accessories also stored in the table. It is also easy to operate by the medical practitioner in an examination or treatment.

An arm support assembly is also provided that includes both an armrest and a connecting assembly for connecting to the medical examination device, such as a table or procedure chair. The armrest may be fully compliant with regulations and standards for transfer supports in medical diagnostic equipment. The connecting assembly and armrest are collectively adjustable to a number of locked positions to place the armrest in preferable orientations for a seated position, supine or lying position, blood pressure reading position, and stowed or patient transfer position. The connecting assembly includes first and second joints that are independently and selectively activated to engage a rotary mechanism and rotational motion of one portion of the joint in relation to another portion of the joint. A rigid elongate member connects the joints to each other, conveying motion from one end of the connecting assembly to the other. A first joint is mounted to the armrest and is a pivot point about which the armrest may be rotated. A second joint may be mounted to the side of the medical examination device, such as a table or chair, and may act as a pivot point for the elongate member. Accordingly, the arm support assembly provides a dual articulating system for full rotation about 360° when unlocked at two separate points to allow for increased freedom of movement and positioning than previous armrests can achieve.

The current leg support assembly and arm support assembly, together with their particular features and advantages, will become more apparent from the following detailed description and with reference to the appended drawings.

DESCRIPTION OF THE DRAWINGS

Like reference numerals refer to like parts throughout the several views of the drawings.

DETAILED DESCRIPTION

Figure 1A:
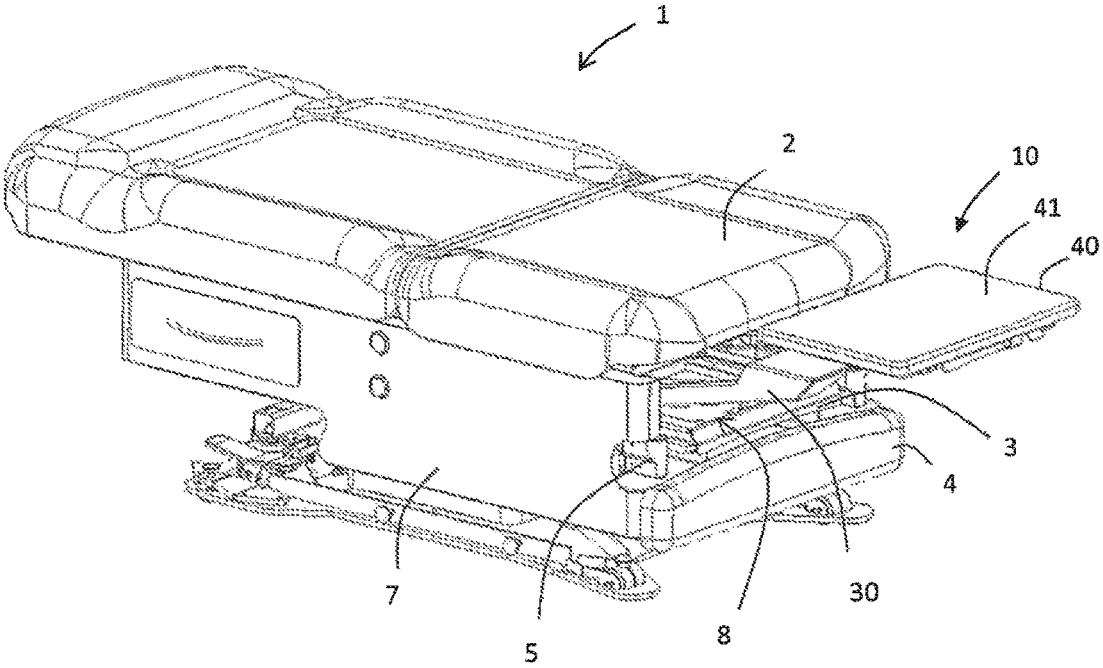
FIG. 1A is an isometric diagram of an embodiment of the medical examination device of the present invention showing the leg support assembly in a deployed position.

As shown in the accompanying drawings, the present invention is directed to a medical examination device 1 having at least one of an elevating leg support assembly 10 and/or an arm support assembly 100. As used herein, a medical examination device 1 may refer to a medical examination table, a procedure chair, or other piece of medical furniture that may be used to support a patient during an examination, diagnostic procedure, treatment procedure, or other medical attention. The medical examination device 1 having either or both leg support assembly 10 and/or an arm support assembly 100 provides an improved experience for both patient and practitioner. For instance, the leg support assembly 10 is co-planar with the seat cushion 2 of the examination device 1 when deployed for use, thereby providing improved patient comfort. The patient's legs no longer must be supported at a downward angle, as is the case with current examination tables. The fully flat position of the patient's legs relative to their body is more consistent with a natural supine position, such as when lying on a bed, as compared to having their legs at a downward angle relative to their body in a supine position. The patient may therefore feel more comfortable and stable in their position on the table. The co-planar positioning may also allow the practitioner to better access areas of the patient for examination and/or performance of procedures. Indeed, the level positioning of the patient's legs with their torso may be required for certain examinations and/or procedures, such as but not limited to abdominal exams and knee exams such as a sweep test. Further, the leg support assembly 10 is easily maneuverable by a practitioner for use and storage when not in use.

Turning now to FIGS. 1A-10, the medical examination device 1 includes a leg support assembly 10. Though reference is made to a "medical" examination table, it should be understood the leg support assembly 10 described herein may be used in conjunction with any type of examination table or support surface. Examples include, but are not limited to, for general medicine, internal medicine, ear nose and throat (ENT), gynecology, proctology, pediatric, gastrointestinal, podiatry, rheumatology, dentistry, optometry, ophthalmology, and imaging. Similarly, although described herein as a table, the medical examination device 1 may be a table, chair, support device, or combination thereof. The medical examination device 1 may be adjustable in a variety of ways unrelated to the leg support assembly 10 or arm support assembly 100, such as but not limited to raising and lowering the support surface such as in a vertical direction, raising and lowering the back and/or headrest such as by rotating relative to the seat cushion 2, tilting the seat cushion 2 forward, rearward or side to side, and tilting the support surface, forward, rearward or side to side. Any or all of such medical examination device 1 adjustments may be performed manually or may be motorized.

Figure 1B:
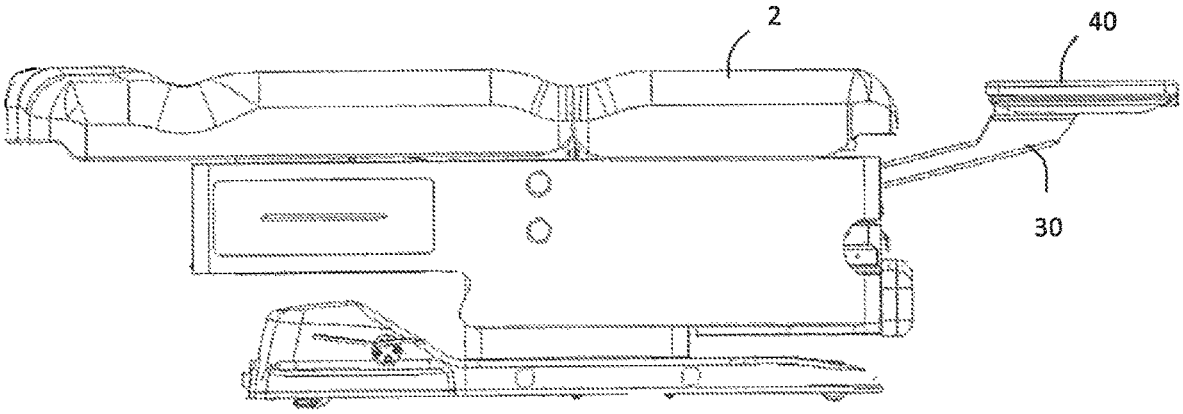
FIG. 1B is a side elevation view of the medical examination device of FIG. 1A.
Figure 3A:
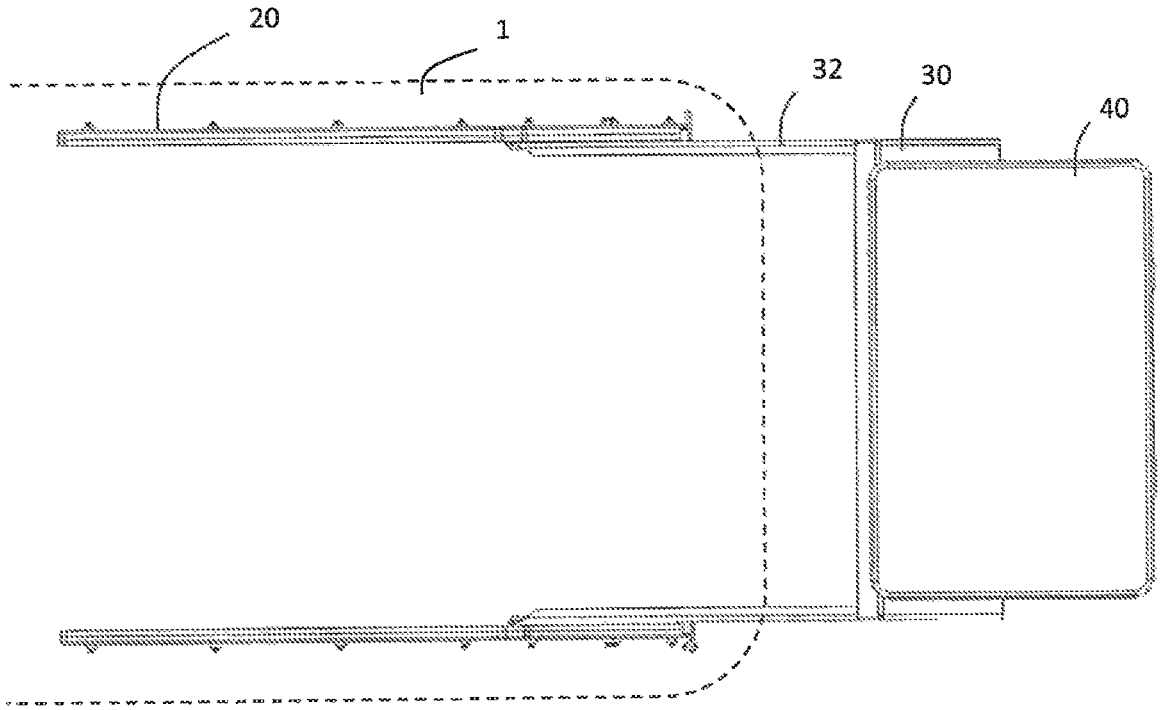
FIG. 3A is a top plan view of the leg support assembly of FIG. 1A in a deployed position, showing the approximate location of the medical examination device in dotted lines.

Once the medical examination device 1 is positioned and adjusted as desired, the leg support assembly 10 may be positioned for use in a deployed position, as shown in FIGS. 1A-1B and 3A. The leg support assembly 10 includes at least one leg pad 40 positionable to receive and support a patient's leg(s) in the deployed position during examination or a procedure. The leg pad 40 may have any configuration suitable for receiving and supporting a patient's leg(s), such as but not limited to rectangular, square, round, oval, curved, grooved and bolstered. The leg pad 40 may be defined by a thickness measured in the vertical direction relative to the ground, a width measured along the side of the leg pad 40 that is parallel to the examination device 1, and a length measured along the side of the leg pad 40 that is perpendicular to the examination device 1. The leg pad 40 may have any suitable dimensions of thickness, width and height as may be appropriate for supporting a patient's leg(s). For instance, in at least one embodiment the width of the leg pad 40 may not exceed that of the examination device 1 and/or seat cushion 2. Similarly, the length of the leg pad 40 may be limited by the length of the examination device 1 or the total length of cushions placed on the examination device 1 (e.g. seat, back and head). Preferably, the leg pad 40 may have a slightly narrower in width than the examination device 1 and may be approximately one quarter of the length of the examination device 1. For instance, the leg pad 40 may measure from 12 to 30 inches wide by 6 to 24 inches long by 0.5 to 6 inches thick. In some embodiments, the leg pad 40 may measure 19.5 inches wide by 12.7 inches long by 0.85 inches thick. The thickness of the leg pad 40 will vary depending on the material of which it is made and the compressive and resilient characteristics of that material. However, the thickness as described herein is measured in the uncompressed state. The leg pad 40 may be made of any suitable material that provides sufficient compression to be comfortable to the patient but also stiffness or resilience to provide support. The material of the leg pad 40 may include upholstery that contacts the patient during use as well as foam, stuffing or padding underneath the upholstery for support, both of which provide support to the patient. For instance, the upholstery of the leg pad 40 may be cloth, microfiber, cotton, synthetic blends, nylon, polyester, leather, synthetic or imitation leather, rubber, silicone and combinations thereof, and may further include stitching. The padding may be made of foam, rubber, silicone, polymeric materials, composite materials, memory foam, beads or microbeads, gel- or fluid-filled cushion. These are but a few illustrative examples and are not intended to be limiting. The leg pad 40 may also include substrate 42 onto which the padding, cushioning and/or upholstery is affixed. Such substrate 42 is sufficiently rigid to provide structure to the leg pad 40 and may define the underside of the leg pad 40 that is opposite of the upper surface 41 contacted by the patient's leg(s) in use. For instance, the substrate 42 may be made of wood, plastic, polymeric material, metal and metal alloys, or combinations thereof, to name a few non-limiting examples.

In some embodiments, the leg pad 40 may have a substantially planar configuration so as to receive and support the leg(s) of a patient thereon. As used herein, "substantially planar" means having a portion that extends along a plane for at least 50% of its top surface. Accordingly, in some embodiments as shown in FIGS. 1A-10, the leg pad 40 may be planar across its entire width and length. Such embodiments may be used universally for any suitable examination or procedure and can accommodate patient legs of any size, shape and length. In other embodiments, the leg pad 40 may include bolstering along at least one side, similar to that of the seat cushion 2 shown in FIGS. 1A-2B, such that bolstered sides of the leg pad 40 align with the bolstered sides of the seat cushion 2 and the center width of the leg pad 40 is substantially planar. In still further embodiments, the leg pad 40 may include more or less padding in various areas, creating a varying topography, with at least a portion of the leg pad 40 being planar. In still other embodiments, the leg pad 40 may have a curved or arcuate configuration in the vertical direction, such as being rounded or dipping in shape. In such embodiments, the leg pad 40 may include only a narrow strip that is planar in the length direction.

In the deployed position, the upper surface 41 of the leg pad 40 of the leg support assembly 10 aligns with at least a portion of the seat cushion 2 of the examination device 1. In other words, the upper surface 41 of the leg pad 40 measures the same distance from the floor or ground as the patient-receiving portion of the seat cushion 2. Accordingly, it may be said that at least a portion of the leg pad 40, such as the upper surface 41, is level with the seat cushion 2 in the deployed position. In some embodiments, this vertical measurement may be taken from anywhere along the centerline of the upper surface 41 of the leg pad 40 and the centerline of the top surface of the seat cushion 2. In some instances, it may be measured from a center of one side or the other of the leg pad 40 and seat cushion 2. The corresponding points measured may preferably be aligned in the longitudinal or length direction. In at least one embodiment, whether the leg pad 40 and seat cushion are aligned or level may involve a comparison of the adjacent edges of the leg pad 40 and seat cushion 2, respectively, in the deployed position.

As shown in the embodiment of FIGS. 1A-1B, the upper surface 41 of the leg pad 40 of the leg support assembly 10 may not only be aligned with but may be co-planar with the seat cushion 2 of the examination device 1. The term "co-planar" as used herein means a surface of the leg pad 40 that receives a patient's leg(s), such as a upper surface 41, extends along the same plane as the primary surface of the seat cushion 2 on which a patient sits during use of the examination device 1. For instance, the seat cushion 2 may have a substantially planar configuration, at least along the sitting portion, but may also include bolstering along the side edges, as shown in FIGS. 1A-1B. In such embodiments, the leg pad 40 of the leg support assembly 10 aligns with or is co-planar with the substantially planar primary surface the seat cushion 2.

In the deployed position, the leg pad 40 may be spaced apart a distance from the seat cushion 2 and/or medical examination device 1, as in FIGS. 1B and 3A. The distance between the leg pad 40 and the seat cushion 2 and/or medical examination device 1 may be predetermined and may be defined by the dimensions and configuration of the leg support assembly 10, as described in greater detail later. For instance, the distance between the leg pad 40 and the seat cushion 2 and/or medical examination device 1 may be in the range of 3 to 12 inches, and preferably 6 inches in at least one embodiment. In further embodiments, the leg pad 40 may be positioned so that at least a portion of the leg pad 40 at least a portion of the seat cushion 2 and/or examination device 1 are adjacent or immediately next to one another in the deployed position, as in FIG. 8B. In some instances, the leg pad 40 may be positioned so that the leg pad 40 and seat cushion 2 contact, touch or are abutting one another. This may be beneficial for patients having shorter leg(s) or to ensure certain parts of the patient's leg is supported during the examination or procedure.

Figure 2A:
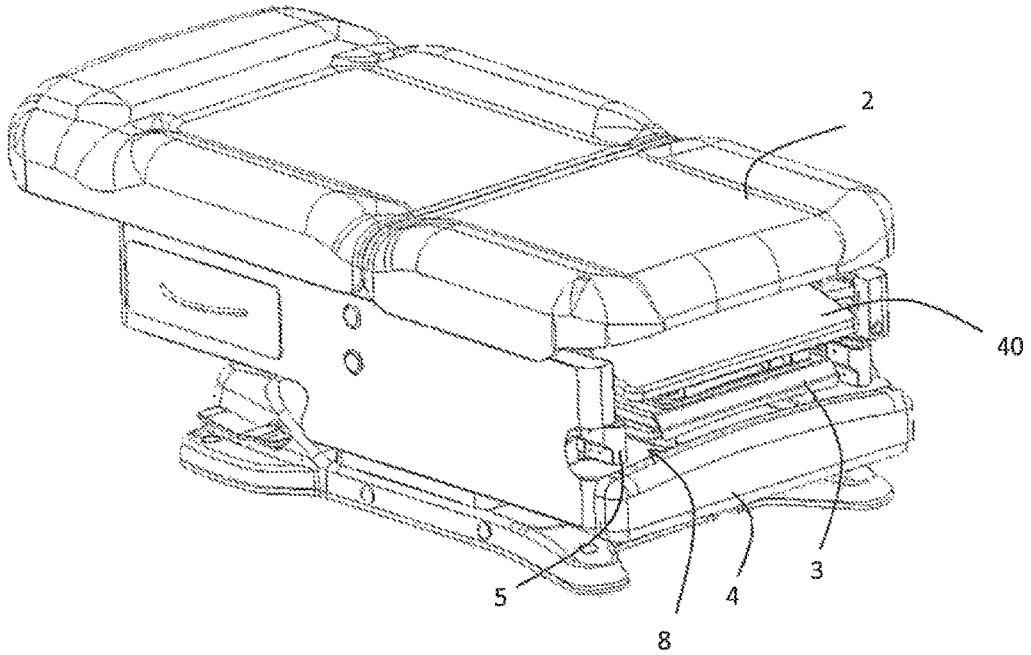
FIG. 2A is an isometric diagram of the medical examination device of FIG. 1A showing the leg support assembly in a stowed position.
Figure 2B:
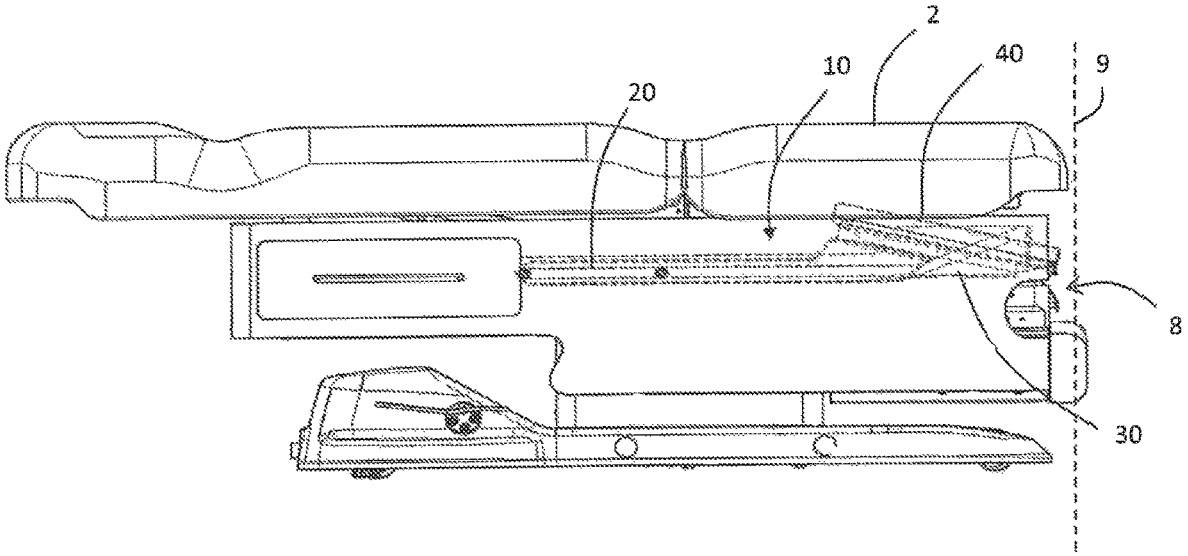
FIG. 2B is a side elevation view of the medical examination device of FIG. 2A.
Figure 3B:
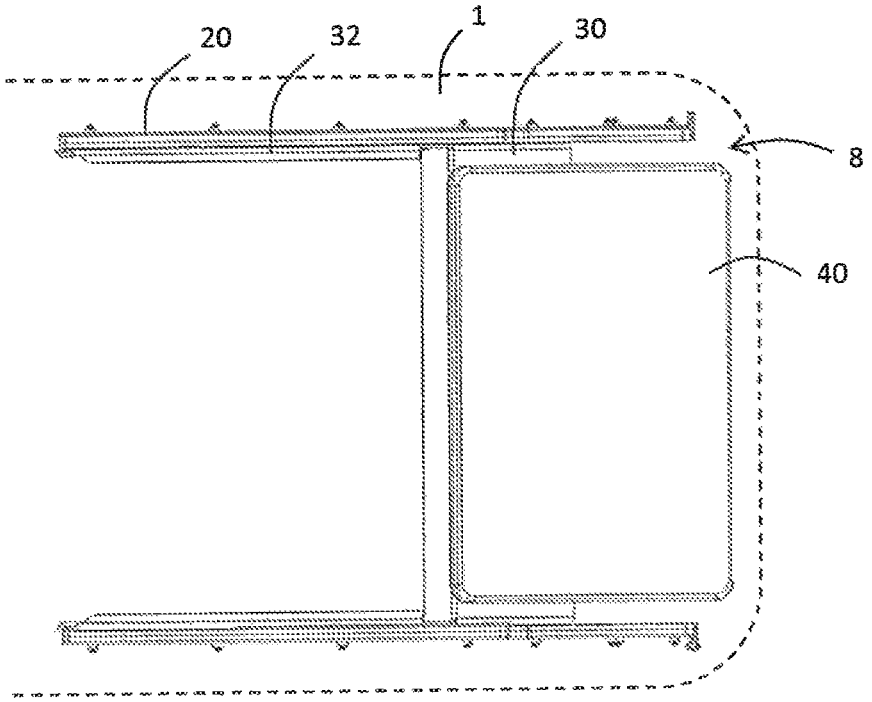
FIG. 3B is a top plan view of the leg support assembly of FIG. 2A in a stowed position, showing the approximate location of the medical examination device in dotted lines.

The leg pad 40 is also dimensioned to fit within a cavity 8 of the medical examination device 1 in a stowed position when not in use, which is depicted in FIGS. 2A-2B and 3B. In the stowed position, the entire leg support assembly 10 is housed within the medical examination device 1, such as underneath the seat cushion 2, back and head cushions in the rearward direction and does not extend beyond the plane 9 that defines the terminal forward edge of the examination device 1 and/or seat cushion 2. Accordingly, the cavity 8 may be defined as the space between the side panels 7 of the examination device 1, the underside of the seat cushion 2 or substrate to which it attaches, the floor or support structure underneath the medical examination device 1, and the terminal forward plane 9. The leg support assembly 10 may therefore have any dimensions such that at least the leg pad 40 and portions of the frame 30 and tracks 20 may be accommodated within the cavity 8 of a medical examination device 1. For instance, the cavity 8 may measure 6.5 inches by 14.9 inches by 24.3 inches. In at least one embodiment, and depending on the structure and various accessories, the cavity 8 may measure 13 inches by 32 inches by 32 inches.

In certain embodiments, the cavity 8 may be limited by the inclusion of other components or accessories stored within the medical examination device 1. For instance, a medical examination device 1 may include a pan 3 that may be used as a drip pan to collect errant fluids during an examination or procedure, or to hold instruments. A drawer 4 may also be included to hold various items such as instruments, linens, exam garments, covers, pillows, and medical equipment or supplies. Stirrups 5 may be present for use in gynecological examinations and procedures. As is common, these additional features may be stored within the medical examination device 1 under the seat cushion 2 and pulled out from a forward terminal end of the examination device 1 for use. When present, these features may reduce the size of the cavity 8 available for storing the leg support assembly 10. For instance, in certain embodiments, the leg support assembly 10 may have dimensions of 3.9 inches by 22 inches by 21.3 inches when a pan 3, drawer 4 and stirrups 5 are included. If any of these accessories are removed, there may be greater height available for the leg support assembly 10, such as up to 8 inches in certain embodiments. Ultimately, the upper limit of the dimensions for the leg support assembly 10 may be defined by the dimensions of the medical examination device 1 and the cavity 8 therein.

Figure 7A:
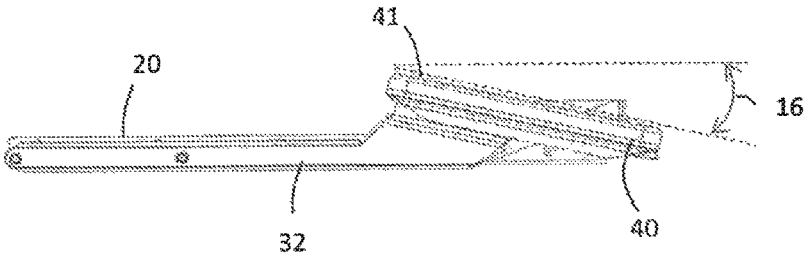
FIG. 7A is a side elevation view of the leg support assembly of FIG. 5A in a stowed position.
Figure 7B:
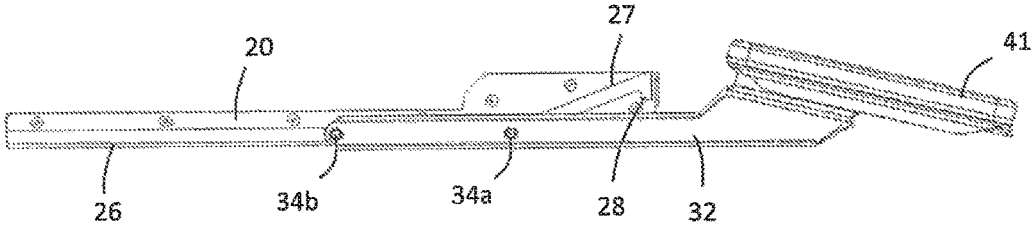
FIG. 7B is a side elevation view of the leg support assembly of FIG. 5B in an intermediate extension position.

As is most evident from FIGS. 2A-2B and 7A, the leg pad 40 is positioned at an angle 16 relative to the horizontal when in the stowed position. This angle 16 may be any angle greater than zero degrees and less than 90 degrees relative to the horizontal and may be selected based on the size of the leg pad 40 and the dimensions of the cavity 8. In some embodiments, the angle 16 may be in the range of 10-40 degrees from the horizontal. In other embodiments, the angle 16 may be in the range of 12-15 degrees from the horizontal. In at least one embodiment, the angle 16 may be 13.5 degrees from the horizontal. It should be appreciated that angle 16 may be any angle, whole or fraction thereof, in the range of 0-90 degrees.

Figure 4:
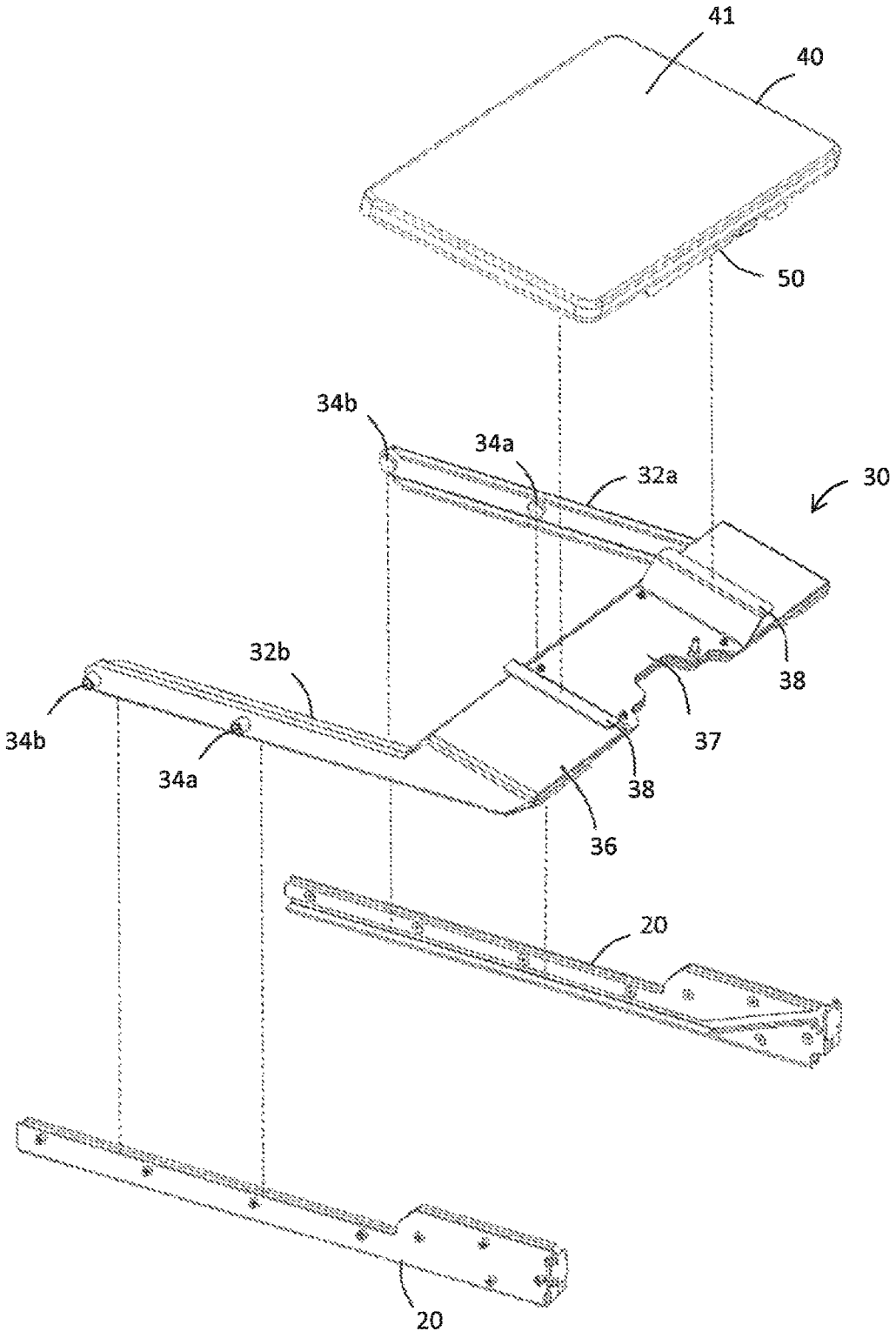
FIG. 4 is an exploded view of the leg support assembly of the present invention.
Figure 5A:
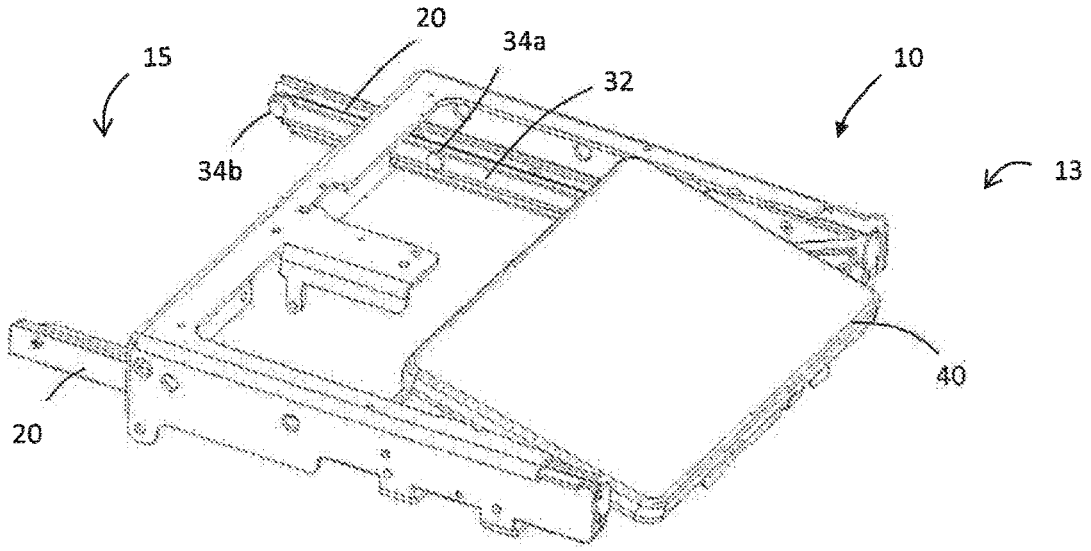
FIG. 5A is an isometric view of the leg support assembly in the stowed position of FIG. 2A.
Figure 5B:
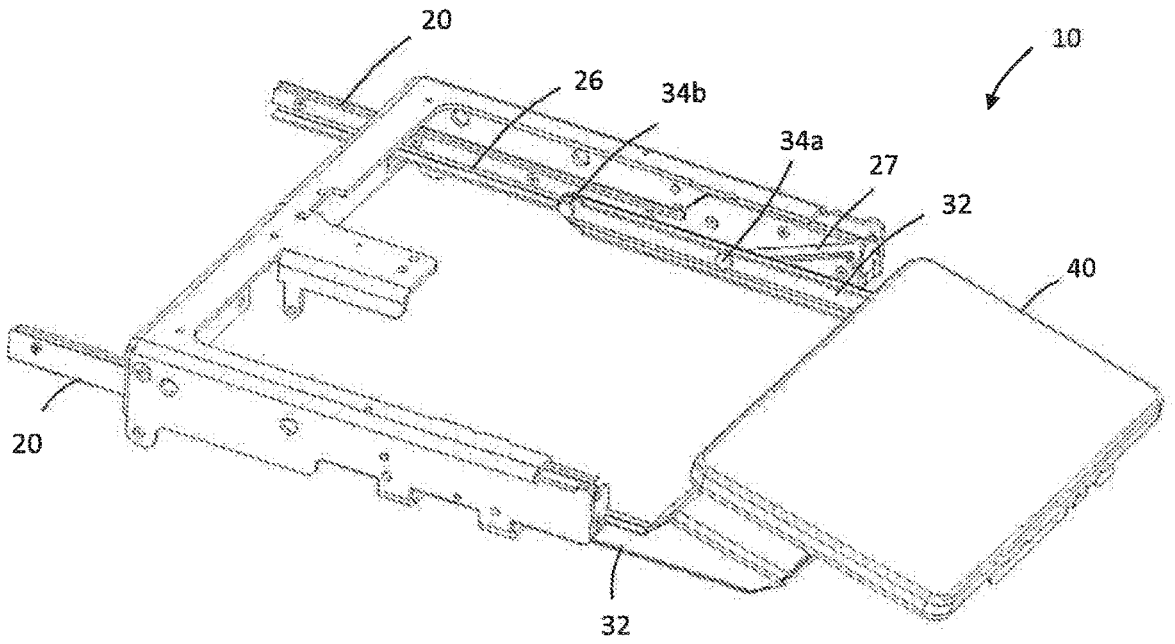
FIG. 5B is an isometric view of the leg support assembly of FIG. 5A in an intermediate extension position.
Figure 5C:
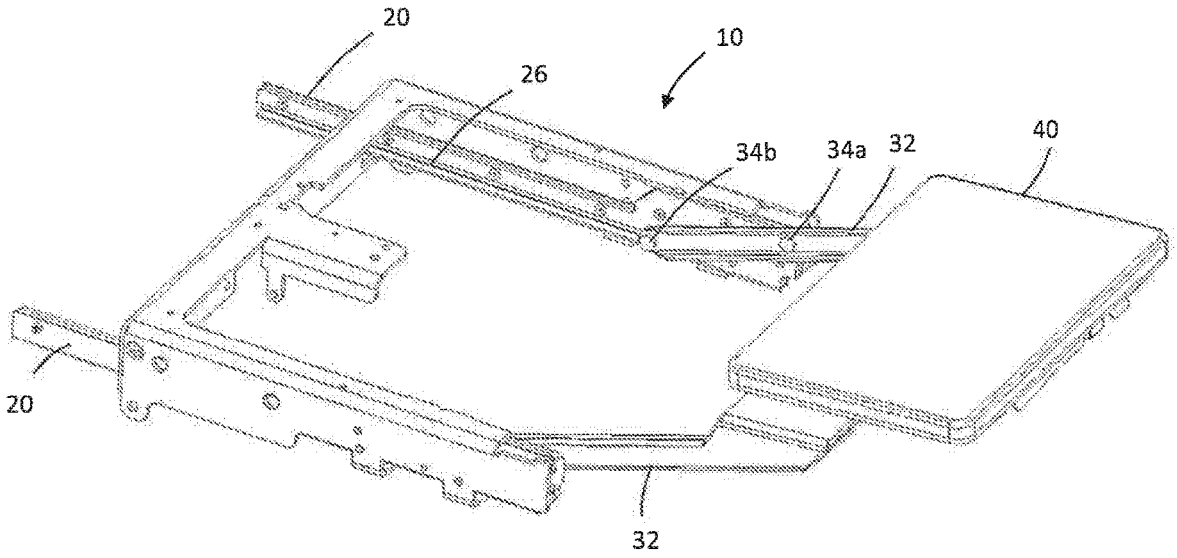
FIG. 5C is an isometric view of the leg support assembly of FIG. 5B in an intermediate inclined position.
Figure 5D:
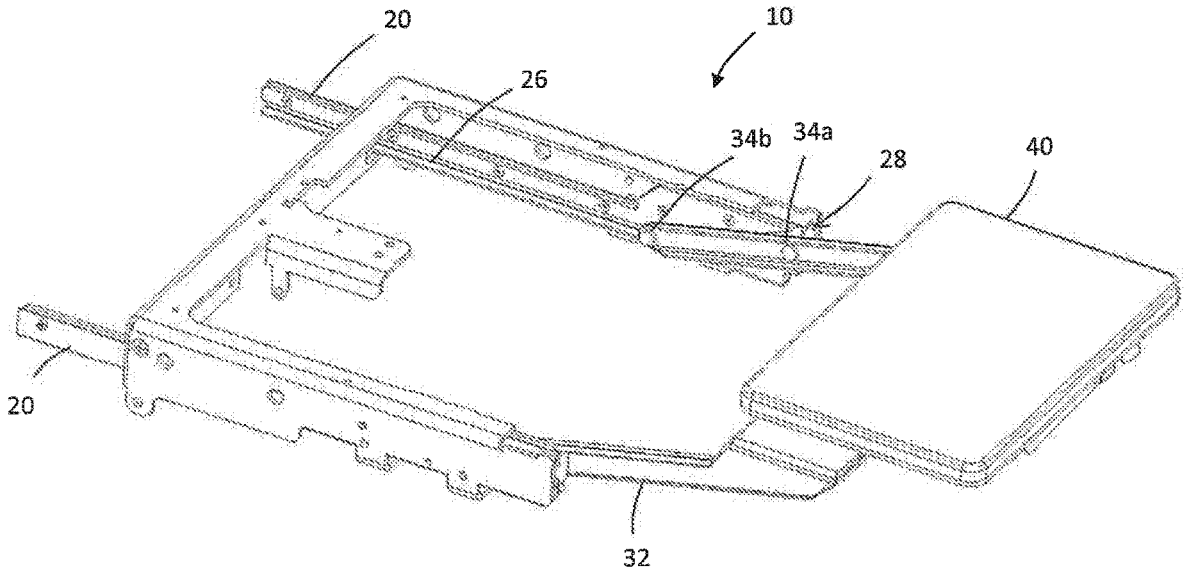
FIG. 5D is an isometric view of the leg support assembly of FIG. 5C in a fully deployed position.

The leg support assembly 10 includes not only a leg pad 40, but also a frame 30 and tracks 20, shown in FIGS. 4-5D. With particular reference to FIG. 4, the frame 30 includes two elongate portions 32*a*, 32*b* disposed parallel to one another. A cross member 36 may span between the elongate members 32*a*, 32*b* at one end thereof, bridging the distance between them and connecting them. In at least one embodiment, the cross member 36 and elongate members 32*a*, 32*b* may be integrally formed with one another of a single piece construction. In some embodiments, however, they may be secured to one another such as by welding, soldering, melting, adhesive, or other permanent attachment. In still other embodiments, the cross member 36 may be secured to the elongate members 32*a*, 32*b* by non-permanent securing members, such as but not limited to bolts, screws and other like reversible securing mechanism. The ends of the elongate portions 32*a*, 32*b* at which the cross member 36 joins are formed at an angle relative to the horizontal such that the cross member 36 sits at an angle relative to the longitudinal axis of the elongate portions 32*a*, 32*b*. This angle defines the angle 16 of the leg pad 40 in the stowed position, as will become clear.

Figure 9A:
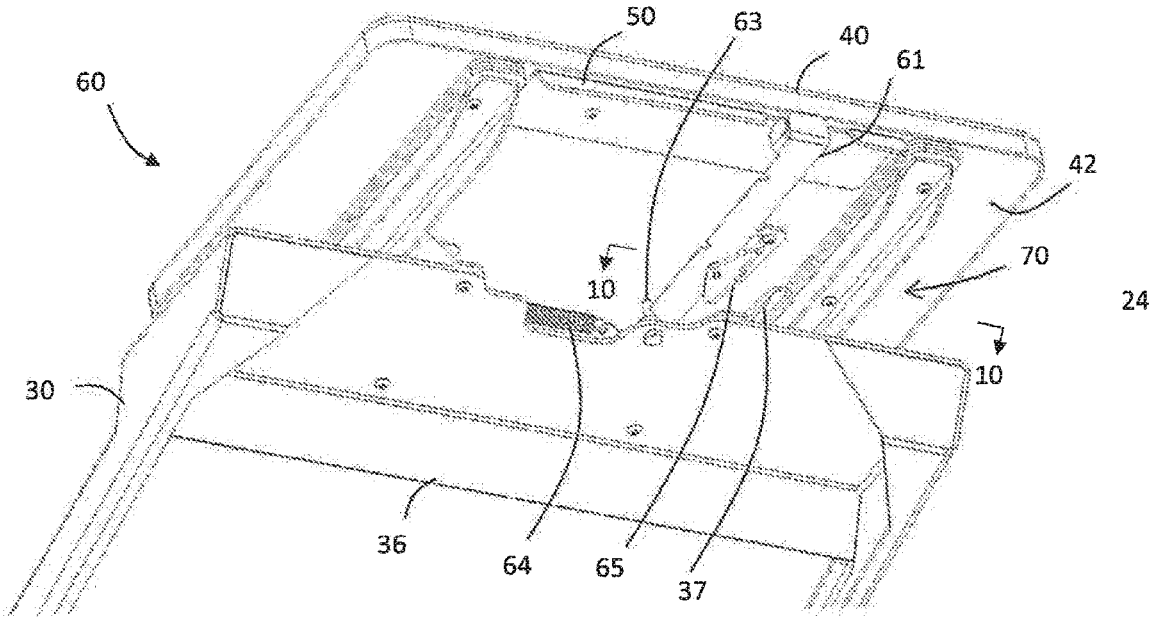
FIG. 9A is an isometric bottom view of the leg support assembly in the fully deployed position and an embodiment of the slide mechanism in the extended position.
Figure 9B:
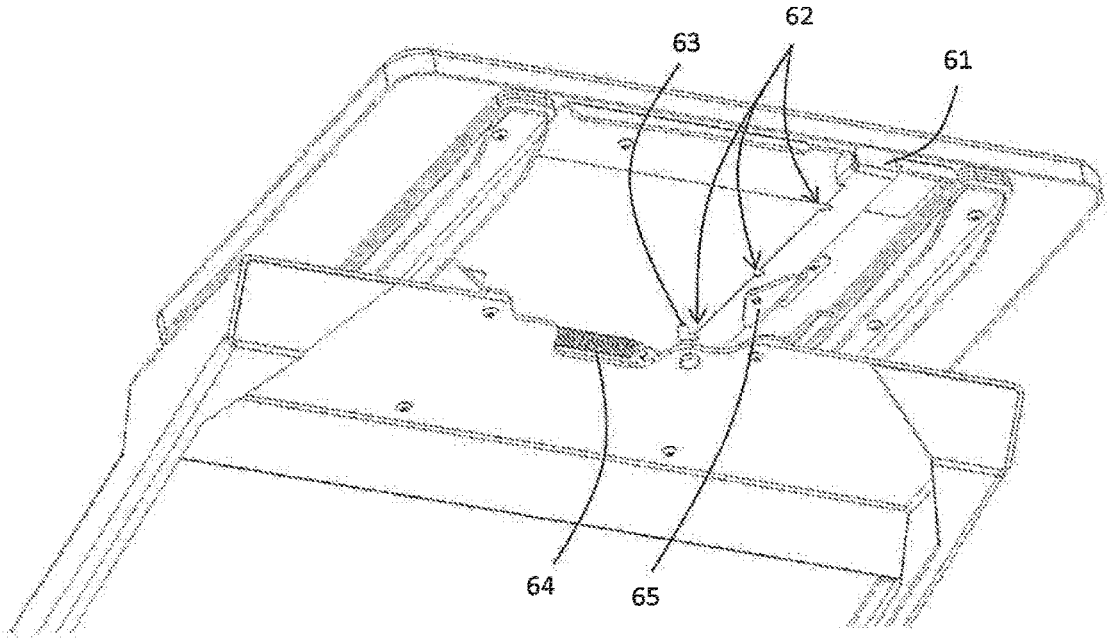
FIG. 9B is an isometric bottom view of the slide mechanism of FIG. 9A showing an unlocked position.
Figure 9C:
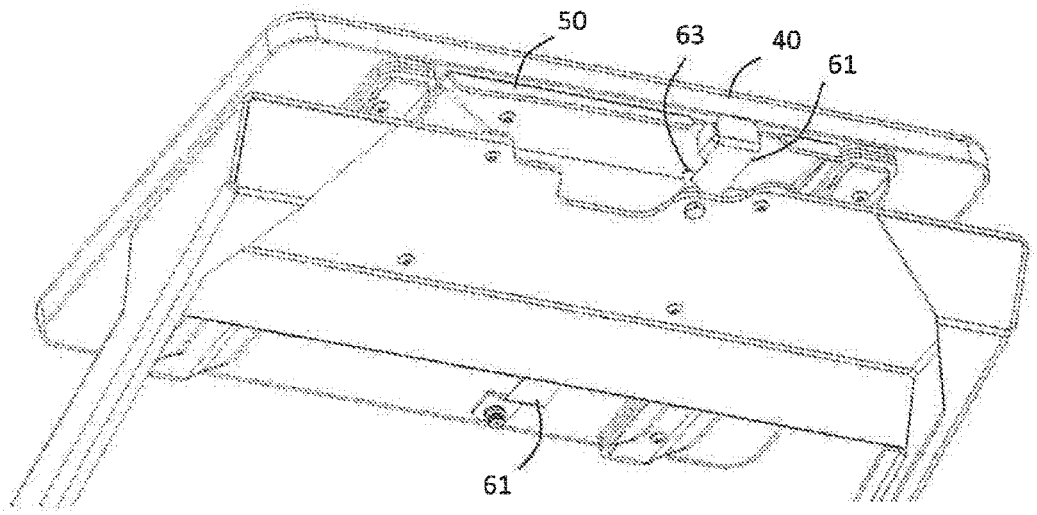
FIG. 9C is an isometric bottom view of the slide mechanism of FIG. 9A showing a retracted position.
Figure 10:
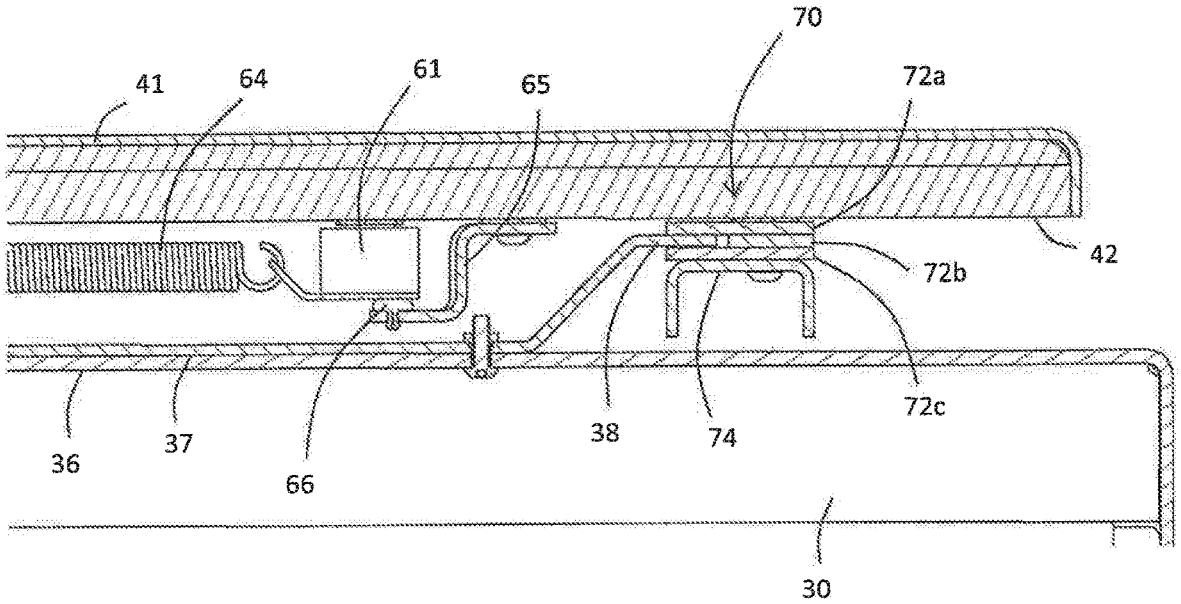
FIG. 10 is a cross-sectional view of the leg support assembly of FIG. 9A along line 10-10.

The frame 30 may be configured to support a leg pad 40. For instance, the frame 30 may connect directly or indirectly to the leg pad 40, which may be a secured or flexible connection. In at least one embodiment, the frame 30 may further include an attachment member 37 that joins the leg pad 40 to the frame 30. With reference to FIGS. 4 and 9C-10, the attachment member 37 secures to the cross member 36 with screws, bolts, nuts, adhesive or the like. The attachment member 37 may further includes at least one extension 38 configured to project outwardly from the frame 36. For instance, in at least one embodiment as shown in FIGS. 4 and 10, the attachment member 37 may be a bracket or other similar joining mechanism where the extensions 38 are wings or arms extending upwardly at an incline and outwardly toward a peripheral edge of the frame 36. The incline of the extension 38 may be any angle up to and including 90 degrees relative to the surface of the cross member 37 to provide space between the cross member 37 and the terminal end of the extension 38. The terminal end of the extension 38 may extend parallel to the surface of the cross member 36 and may extend toward any of the peripheral edges of the frame 30. In some embodiments, as in FIG. 4, the attachment member 37 may include multiple extensions 38. Extensions 38 within the same attachment member 37 may extend at the same or different angles of incline relative to the surface of the cross member 36 as one another and may be directed toward the same or different peripheral edges of the frame 30. The length of the terminal ends of each extension 38 may be the same or different from one another, and they may have the same or different configurations.

Further, the attachment member 37 may be secured to any location along the cross member 36. In some embodiments, there may be a plurality of attachment members 37, each secured to the cross member 36. The various attachment members 37 may be secured in different orientations relative to one another, or in the same orientation, along the cross member 36. The angle of incline and the direction and/or length of the terminal end of the extension 38 among the various different attachment member 37 may be the same or different from one another.

In at least one embodiment such as shown in FIGS. 4 and 10, the leg pad 40 includes a spacer assembly 70 that connects the leg pad 40 to the frame 30. Specifically, the spacer assembly 70 may includes at least one buffer 72 that is secured to the underside of the leg pad 40 or substrate 42 thereof by a backing 74 and screw, nut and bolt, pin, or other suitable attachment mechanism that retains the buffer 72 between the underside of the leg pad 40 and the backing 74. The buffer 72 may be made of a rigid or semi-rigid material, such as but not limited to plastic(s), polymeric material, metal(s) and metal alloys. The backing 74 may be made of the same or different material as the buffer 72 and may have any suitable configuration for contacting the buffer 72. For instance, the backing 74 may have a U-shape as depicted in FIGS. 9C and 10, with the central portion contacting the buffer 72. In other embodiments, the backing 74 may be planar, curved, angular, C-shaped, L-shaped, V-shaped or other shapes capable of contacting the buffer 72 along at least a portion thereof, including as little as a point or line there along.

In at least one embodiment, as depicted in FIGS. 9C and 10, the spacer assembly 70 may include a plurality of buffers 72*a*, 72*b*, 72*c* positioned adjacent to one another in a contacting configuration, which may be stacked as shown. The buffers 72*a*, 72*b*, 72*c* may be made of a rigid or semi-rigid material, such as but not limited to plastics, polymeric material, metals and metal alloys. In at least one embodiment, the spacer assembly 70 is secured to the underside of the leg pad 40 or substrate 42 thereof by a screw, nut and bolt, pin, adhesive, or other suitable attachment mechanism that retains the buffers 72*a*, 72*b*, 72*c* in contacting relation to one another and against the underside of the leg pad 40.

At least one of the buffers 72*b* may have a different configuration from at least one of the adjacent buffers 72*a*, 72*c* to either side so that a space or groove is formed between the buffers 72*a*, 72*b*, 72*c* when in contact with one another. For instance, in some embodiments, non-contacting buffers 72*a*, 72*c* may have the same configuration, such as but not limited to a bar, block or other shape. The intermediate buffer 72*b* may have a smaller configuration but smaller in one direction. The difference in the configurations or shapes of the non-contacting buffers 72*a*, 72*c* and intermediate buffer 72*b* when positioned together forms the aforementioned space or groove. In other embodiments, the space or groove may be formed by a notch formed in one side of the intermediate buffer 72*b*. In some embodiments where there is only a single buffer 72, the space or groove may be a space adjacent to the buffer 72 and defined by adjacent edges of the underside of the leg pad 40, the buffer 72, and the backing 74. In at least one embodiment, the spacer assembly 70 is secured to the underside of the leg pad 40 or substrate thereof with the space/groove facing inward toward the center of the leg pad 40. The leg pad 40 may include two or more such spacer assemblies 70, and each may be secured such that the space/groove of each is facing inward toward the center of the leg pad 40. In other embodiments, the space/groove may be facing outwardly from or at an angle relative to the center of the leg pad 40.

The space or groove formed in the spacer assembly 70 is sized and dimensioned to receive and retain at least the terminal end of the extension 38 of the attachment member 37 of the frame 30. With reference to FIGS. 4 and 10, the leg pad 40 may be attached to the frame 30 by positioning the leg pad 40 such that the spacer assembly 70, specifically the groove thereof, is aligned with the extension 38 of the attachment member 37. In at least one embodiment, the groove of the spacer assembly 70 receives the extension 38 of the attachment member 37, such as the terminal end thereof, shown in FIG. 10. The extension 38 may be retained within the groove of the spacer assembly 70 by gravity, since the backing 74 holds and affixes the spacer assembly 70 to the underside of the leg pad 40. Accordingly, in at least one embodiment the spacer assembly 70 may be held securely onto the leg pad 40, but not so tightly that the groove formed therein is compressed. The groove is dimensioned to allow the attachment member 37, specifically the extension 38 thereof, to be inserted therein, such as by a sliding action. In some embodiments, the extension 38 may also be freely slid out of the groove of the spacer mechanism 70, such as when it is desired to change the leg pad 40 for one with a different shape, configuration, material composition, etc. In other embodiments, however, the leg pad 40 may be firmly affixed to the frame 30 and not readily removable. For instance, the backing 74 may be secured to an initial tightness in assembling the spacer assembly 70, and then may be further tightened once the extension 38 of the attachment member 37 is inserted in the groove, thus including the extension member 38 in securing the attachment member 37 to the leg pad 40.

Returning to FIG. 4, once the leg pad 40 is connected to the frame 30 at the attachment member 37, the leg pad 40 assumes the angle 16 as previously discussed, since it is the same as the angle of the cross member 36 and/or attachment member 37 relative to the elongate members 32*a*, 32*b* of the frame 30. Indeed, in at least one embodiment, the end of the elongate members 32*a*, 32*b* that connect to the cross member 36 may be formed with a predetermined and fixed configuration producing an angle that is followed by the cross member 36, as shown in FIG. 4.

The frame 30 further includes at least a first guide member 34*a* and second guide member 34*b* affixed at predetermined locations along the length of an elongate member 32. In certain embodiments, the frame 30 may include pairs of first guide members 34*a* and pairs of second guide members 34*b*. The guide members 34*a*, 34*b* extend through the elongate member 32 and outwardly from the outer surface thereof. For the avoidance of doubt, references to "outer" or "exterior" throughout this disclosure refers to the direction of the periphery of the leg support assembly 10, whereas "inner" or "interior" may be used to refer to the direction toward the three-dimensional center of the leg support assembly 10. The guide members 34*a*, 34*b* may be pins, rollers, wheels and axles, rods, or other suitable structures that extend through the elongate member 32. In some embodiments, the guide members 34*a*, 34*b* may include bearings, bushings, or other similar structures disposed coaxially or concentrically about at least a portion of the guide members 34*a*, 34*b*, such as the portion which extends beyond the outer surface of the elongate member.

A predefined fixed length separates the first and second guide members 34*a*, 34*b*, which may be any distance along the length of the elongate member 32. In at least one embodiment, for instance, the first and second guide members 34*a*, 34*b* may be separated by 7.5 inches. The first guide member 34*a* is positioned closer to the cross member 36 and the forward end 13 of the leg support assembly 10. In at least one embodiment, the second guide member 34*b* may be located at or near a terminal end of the elongate member 32 opposite from the cross member 36. It should be noted that, although the guide members 34*a*, 34*b* are positioned at fixed locations, they may be movably secured within the elongate member 32. For instance, the guide members 34*a*, 34*b* may be rollers or wheels free to rotate about an axis without changing their location along the length of the elongate member 32. In other embodiments, the guide members 34*a*, 34*b* may be fixedly secured within or to the elongate member 32, such as but not limited to pins or rods. In at least one embodiment, the frame 30 includes two elongate members 32 and each includes a first guide member 34*a* and a second guide member 34*b*. The first guide members 34*a* of parallel elongate members 32 may be aligned with one another, and the second guide members 34*b* of parallel elongate members 32 may be aligned with one another.

Referring to FIG. 4, the leg support assembly 10 further includes at least one track 20, and preferably a pair of tracks 20 that may be configured to correspond to the frame 30. For instance, each track 20 may have an elongate length similar in length and/or size to the elongate member 32 of the frame. Indeed, the elongate length of the tracks 20 correspond to the elongate members 32 of the frame 30. As shown in FIG. 4, each track 20 is dimensioned to receive the first and second guide members 34*a*, 34*b* of the frame 30. The first and second guide members 34*a*, 34*b* may be moved along the length of the track 20.

Figure 6:
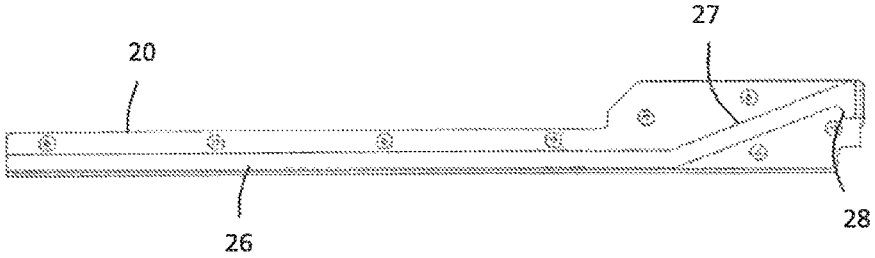
FIG. 6 is diagram of the interior side of one track of the leg support assembly.

The track 20 includes a horizontal section 26, an inclined section 27 and a detent 28, such as is depicted in FIG. 6. The horizontal section 26 extends along at least a portion of the length of the track 20. In at least one embodiment, the horizontal section 26 may extend along a majority of the length of the track 20. The inclined section 27 extends from the horizontal section 26 at an angle thereto, which may be any angle greater than zero degrees and less than 90 degrees relative to the horizontal section 26. For instance, in some embodiments, the angle of incline of the inclined section 27 may be in the range of 10° to 60°, and in certain embodiments may be 22°. In at least one embodiment, the inclined section 27 extends from one end of the horizontal section 26 and is co-extensive and continuous with the horizontal section 26. The length of the inclined section 27 may be any length limited only by the length of the track 20. In at least one embodiment, for instance, the inclined section 27 may measure 5.9 inches. The detent 28 may extend from the inclined section 27 at an angle thereto, such as in the range of 10° to 90° relative to the horizontal section 26, and in some instances may be in the range of 18° to 45°. In at least one embodiment, the detent 28 extends from a terminal end of the inclined section 27 that is opposite from the horizontal section 26. Accordingly, the detent 28 may be co-extensive and continuous with the inclined section 27. The detent 28 may have any shape or configuration, but generally is configured to support a first guide member 34*a* at a height that is lower than the highest point of the inclined section 27. The horizontal section 26, inclined section 27 and detent 28 may therefore collectively form a continuous contact surface for the first and second guide members 34*a*, 34*b*. In at least one embodiment, the detent 28 may be configured to receive and retain at least a portion of a guide member 34 therein to secure the guide members 34 along the track 20 and therefore to secure the leg support assembly 10 in a deployed position.

Each track 20 may be secured to the interior of the medical examination device 1, such as to the inside of the side panels 7 defining the cavity 8. The outer surface of each track 20 abuts and contacts the side panel 7 or frame of the medical examination device 1 and may be secured thereto by any suitable connection mechanism such as but not limited to screws, nuts, bolts, welding, soldering, and adhesive. The guide members 34*a*, 34*b* contact and are received by the tracks 20, slidably joining the frame 30 to the tracks 20. The leg pad 40 then affixes to the frame 30 through the attachment member 37, as described above.

The leg support assembly 10 remains stowed within the cavity 8 of the medical examination device 1 until it is needed. In the stowed position, as shown in FIGS. 2B, 5A and 7A, the leg pad 40, and specifically the upper surface 41 of the leg pad 40, is positioned at angle 16 relative to the horizontal and fits entirely within the cavity 8. When stowed, the leg pad 40 is angled downward in the forward position, as shown in FIGS. 2A-2B and 7A, and both sets of guide members 34*a*, 34*b* are in the horizontal section 26 of the track 20, shown in FIGS. 5A and 7A. In a fully stowed position, the second guide members 34*b* may be located at the rearward terminal end of the track 20.

When it is desired to have the leg pad 40 available for patient use, a practitioner or other user may grasp and pull the leg pad 40, such as by the handle 50 thereof, in a forward direction. As used herein, "forward" is the direction in which the cavity 8 of the medical examination device 1 opens and the direction in which a patient's legs extend off the table when seated therein, and is shown as the first end 13 in FIG. 5A. "Rearward" is the opposite direction, toward the head of the table, shown as the second end 15 in FIG. 5A. As the leg pad 40 moves forward, the attached frame 30 similarly moves. The guide members 34*a*, 34*b* move along a common track 20 in a forward direction, as shown in FIG. 5B. When the first guide members 34*a* reach the inclined section 37 of the track 20, the leg support assembly 10 has traveled the maximum amount of distance in a purely horizontal disposition and has reached an intermediate extension position shown in FIGS. 5B and 7B. Further forward movement of the leg pad 40 pulls the first guide members 34*a* into the inclined section 27. As the first guide members 34*a* move along the inclined section 27, the frame 30 and leg pad 40 moves both outward and upward, elevating the leg pad 40 from its original position. When the first guide members 34*a* reach the forward end of the inclined section 27, the leg pad 40 has achieved the maximum vertical displacement from its original position and may be slightly higher than the seat cushion 2 of the examination device 1. The second guide members 34*b* remain in the horizontal section 26 of the track 20, even at this forward-most position, shown in FIG. 5C. To lock the leg support assembly 10 in a deployed position, shown in FIGS. 5D and 7C, the leg pad 40 is lowered vertically, moving the first guide member 34*a* into the detent 28 of the track 20. The detent 28 receives and retains the first guide member 34*a*, such as by gravity. When the leg pad 40 or handle 50 is released, the leg support assembly 10 remains in the deployed position, shown in FIGS. 5D and 7C. To return the leg support assembly 10 to the stowed position, the leg pad 40 or handle 50 is simply lifted to move the first guide member 34*a* out of the detent 28, at which point the first guide member 34*a* is free to slide rearward down the inclined section 27 and back along the horizontal section 26.

Figure 7C:
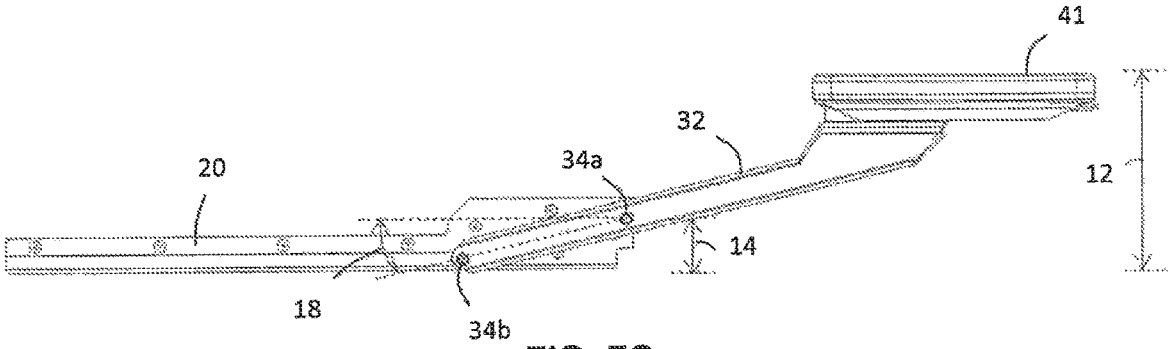
FIG. 7C is a side elevation view of the leg support assembly of FIG. 5D in a fully deployed position.
Figure 8A:
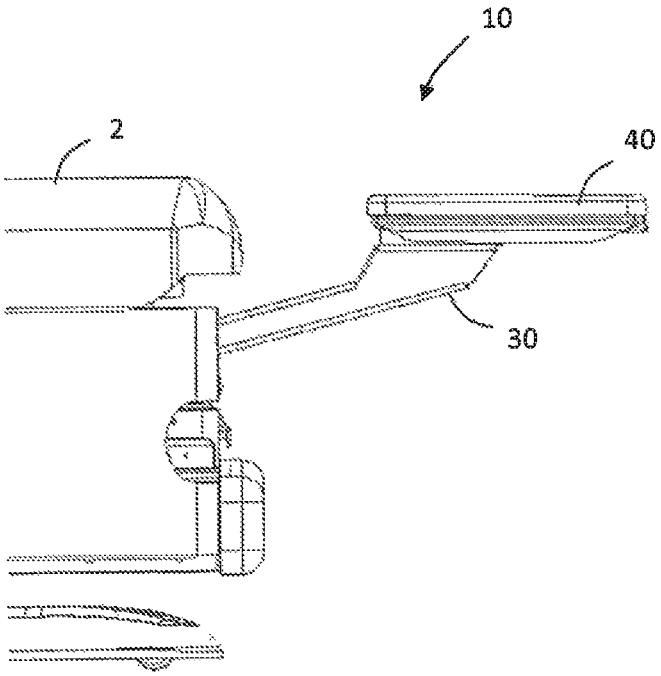
FIG. 8A is a side elevation view of the forward end of the medical examination device showing the leg support assembly in the deployed position.
Figure 8B:
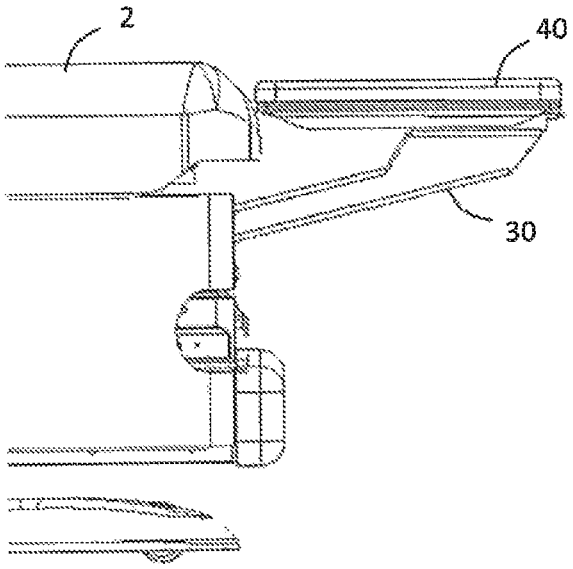
FIG. 8B is a side elevation view of the medical examination device of FIG. 8A showing the leg pad of the leg support assembly in a retracted position.

In the deployed position shown in FIGS. 5D and 7C, the upper surface 41 of the leg pad 40 is co-planar with at least a portion of the seat cushion 2 of the medical examination device 1, as depicted in FIG. 1A-1B. This is distinct from current medical examination tables in which the leg pad slides out from a stored position below the table but remains parallel to and below the level of the seat cushion. The present invention delivers a way to elevate the leg pad 40 so that it is level with the seat cushion 2 when deployed, providing greater comfort to the patient and benefitting the provider as well.

Not only does the leg support assembly 10 deploy the leg pad 40 so its upper surface 41 is even with the seat cushion 2, but the vertical distance 12 the leg pad 40 travels from the stowed position to the deployed position is greater than the vertical distance 14 the first guide member 34*a* travels within the slot 22, as shown in FIG. 7C. In other words, the present leg support assembly 10 is able to achieve greater elevation of the leg pad 40 than the height dimension of the cavity 8 where the leg support assembly 10 is stowed. The vertical distances 12, 14 will vary depending on the dimensions of the medical examination device 1, which will direct the available space in the cavity 8 and the maximum dimensions of the leg support assembly 10. For example, in some embodiments, vertical distance 12 may be about 6.7 inches whereas vertical distance 14 may be 1.7 inches. However, the ratio of vertical distance 12 to vertical distance 14 may be fixed and may be in the range of 1.5 to 10, such as about 3.9 in some embodiments. The particular ratio of vertical distance 12 to vertical distance 14 may depend on the size and strength of materials used in the tracks 20 and frame 30. For instance, a smaller ratio may be achieved with longer tracks 20 and frame elongate members 32, but requires stronger material, and vice versa.

The enhanced elevation is due in part to the angling of the leg pad 40 and the inclined nature of the slot 22. Specifically, the angle 18 formed between the guide members 34*a*, 34*b* when in the deployed position relative to the horizontal (or relative to the line formed by the guide members 34*a*, 34*b* in the stowed position) is substantially equivalent to the angle 16 of the leg pad 40 relative to the horizontal (or relative to the horizontal section 26 of the track 20) in the stowed position. As used herein, "substantially equivalent" means no appreciable difference perceived by the patient and may include within tolerance of ±10 degrees, although greater deviations are also contemplated so long as the upper surface 41 of the leg pad 40 is substantially coplanar with at least a portion of the seat cushion 2. Angles 16 and 18 may be any angle greater than zero degrees and up to 90 degrees, limited only by the dimensions of the cavity 8 and leg pad 40. In at least one embodiment, angles 16 and 18 may be in the range of 2-20 degrees, and preferably be 13.5 degrees. Notably, angle 18 is not the same as the angle of the inclined section 27. Indeed, angle 18 may be smaller than the angle of the inclined section 27 relative to the horizontal, since angle 18 is formed by the positions of the guide members 34*a*, 34*b* in the deployed position in which the first guide member 34*a* is lowered into the detent 28, therefore changing the angle.

The leg support assembly 10 may be positioned in a number of deployed positions. The angles of the guide members 34*a*, 34*b* and leg pad 40 remain the same regardless of the deployed positions. However, in a first deployed position, shown in FIG. 8A, the leg pad 40 is co-planar with but spaced apart a distance from the seat cushion 2. In a second deployed position, as in FIG. 8B, the leg pad 40 is co-planar with and abutting, adjacent or contacting the seat cushion 2. For the avoidance of doubt, the terms "abutting," "adjacent," and "contacting" may be used interchangeably with reference to the relationship between the leg pad 40 and seat cushion 2 to mean at least one portion of the leg pad 40 is next to at least one portion of the seat cushion 2 so there is no appreciable distance between the relevant portions of each. In at least one embodiment, the first deployment position is achieved initially upon moving the leg support assembly 10 out of stowage. It may remain in this first deployed position or may be retracted horizontally into the second deployed position if so desired. For instance, it may be preferable to have the leg pad 40 abutting, adjacent or contacting the seat cushion 2, such as for patients with shorter legs, or if support of the patient's legs throughout their length is preferred without a gap.

The leg support assembly 10 may include a slide mechanism 60 to facilitate the movement of the leg pad 40 between the first and second deployed positions. For instance, as shown in FIGS. 9A-10, the slide mechanism 60 includes a locking lever 61 attached to the leg pad 40. As before, attachment to the leg pad 40 may be directly to the leg pad 40 itself or to a substrate 42 to which the leg pad 40 padding and/or upholstery is secured. The locking lever 61 may preferably have a length that spans at least a portion of the length of the leg pad 40. The locking lever 61 may be attached to the underside of the leg pad 40 in any orientation, but in at least one embodiment is attached in the length dimension of the leg pad 40 between the forward and rearward sides of the leg pad 40, with the rearward side of the leg pad 40 being the closest to the seat cushion 2. The locking lever 61 may be pivotably attached to the underside of the leg pad 40 as shown in FIG. 10 and may be held in position with a biasing member 64, such as but not limited to a spring. The biasing member 64 pulls the locking lever 61 toward itself, which may be overcome by pushing against the locking lever 61 in the opposite direction. Accordingly, the locking lever 61 is movably secured to the leg pad 40.

The sliding mechanism 60 may further include a support member 65 spaced apart from and dimensioned to receive at least a portion of the locking lever 61. For instance, in at least one embodiment of FIGS. 9A and 10, the support member 65 may be secured to the leg pad 40 spaced apart a distance from the locking lever 61 in a lateral direction. The distance of separation may vary but is smaller than the total possible displacement of the locking member 61 when selectively moved, such as by pivoting. In at least one embodiment, the support member 65 may be secured to the leg pad 40 opposite from the biasing member 64, such that the locking lever 61 is positioned between the biasing member 64 and the support member 65. The support member 65 is dimensioned to receive at least a portion of the locking member 65 in an unlocked position. In at least one embodiment, the unlocked position may be achieved by applying pressure to the locking lever 61 in a direction opposite from the biasing member 64.

In some embodiments, the support member 65 may also include a protrusion 66 that extends outwardly from the support member 65 and is configured to engage the locking lever 61, to hold it in a spaced relation to the support member 65 and provide support to the locking lever 61 so it need not cantilever from its pivot point. The protrusion 66 may be rubber, silicone, plastic or other suitable material that may provide support to the locking lever 61 but also permit movement of the locking lever 61 there along such as in the lateral direction. In such embodiments, the locking lever 61 may therefore contact a portion of the support member 65, such as the protrusion 66, even when the locking lever 61 is in a locked position. In such embodiments, the locking lever 61 remains spaced apart from at least one other portion of the support member 65, as shown in FIG. 10, which may receive the locking lever 61 upon application of force to overcome the biasing member 64.

In at least one embodiment, the locking lever 61 may include a plurality of notches 62 or similar structure formed therein. The notches 62 may be formed in one side of the locking lever 61, preferably the side that faces the biasing member 64. Each notch 62 corresponds to a different position in which the leg pad 40 may be moved closer to or further from the seat cushion 2. There may be any number of notches 62 in the locking lever 61 depending on the number of desired positions of the leg pad 40. The slide mechanism 60 may also include a locking member 63 configured to retain the slide mechanism 60, and therefore the leg pad 40, in a particular position. Specifically, the locking member 63 extends through the frame 30, such as the cross member 36, and may be perpendicular to the locking lever 61 and notches 62 disposed therein. The locking member 63 is configured to fit at least partially within the notch 62 of the locking lever 61. In at least one embodiment, the locking member 63 may be a screw, bolt, pin, or other similarly elongate structure that secures to the frame 30. Each notch 62 may have a diameter and/or shape corresponding to the diameter of the locking member 63, such as circular or semi-circular, so as to at least partially receive the locking member 63 therein.

In a locked position as in FIG. 9A, the locking lever 61 is biased by the biasing member 64 so that a notch 62 is biased against the locking member 63. FIG. 9A shows the leg pad 40 positioning and slide mechanism 60 in the initial deployed position of FIG. 8A. To move the leg pad 40 rearward, pressure is applied to the locking lever 61 in a direction away from the biasing member 64, as in FIG. 9B. This pressure overcomes the force of the biasing member 64 and moves the locking lever 61 in the direction of and against the support member 65, although contact is not required. The notch 62 is no longer in contact with the locking member 63, and the leg pad 40 is freely slidable in the axial direction of the locking lever 61. When another notch 62 aligns with the locking member 65, the pressure on the locking lever 61 may be released. The force of the biasing member 64 draws the locking lever 61 away from the support member 65 and pulls the notch 62 into contact with the locking member 63 so it receives at least a portion of the locking member 63 therein. The locking member 63 in the notch 62 prevents axial movement of the leg pad 40 along the axis of the locking lever 61. This process may be repeated to move the leg pad 40 between the various positions delineated by the notches 62 present along the locking lever 61. It should be appreciated that the notches 62 need not be engaged sequentially, but rather the particular notch 62 for the corresponding position desired may be selected before releasing the pressure on the locking lever 61 against the support member 65. FIG. 9C depicts an embodiment of a fully retracted deployed position in which the leg pad 40 is abutting the seat cushion, as in FIG. 8B. Here, the forward-most notch 62 of the locking lever 61 engages the locking member 63. Accordingly, the fully extended deployment position of FIG. 8A may be achieved by engaging the rearward-most notch 62 along the locking lever 61.

In other embodiments, the leg pad 40 may be moved in along the continuum of the locking lever 61 to any position there along and is not limited by predefined notches 62. For example, the locking member 63 may be a clamp or similar structure capable of frictional engagement of the locking lever 61 at any point there along to prevent the axial movement of the leg pad 40. In such embodiments, the locking lever 61 may not include notches 62, but rather may engage the locking member 63 at any point there along.

The present invention is also directed to an arm support assembly 100, shown in FIGS. 11-21. The arm support assembly 100 may be provided on a medical examination device 1 or procedure chair and may be present in connection with or without a leg support assembly 10 as previously described. Although the present arm support assembly 100 may be used on either a medical examination device 1 or procedure chair, it should be noted that these are distinct medical devices and are not interchangeable. Further, the present arm support assembly 100 may be attached to any surface or device on which a patient may sit or lie for medical, dental, or health care examinations, procedures, administration, recovery, or evaluation.

As shown in FIGS. 11-21, the arm support assembly 100 of the present invention includes an armrest 110 configured to receive and support a patient's arm thereon, and a connecting assembly 120 configured to connect the armrest 110 to the medical examination device 1 or procedure chair. As will be described in greater detail below, the connecting assembly 120 is a double-articulating mechanism connecting to both the armrest 110 at one end and the device 1 or chair at the other end for selective adjustment to a number of different locked positions.

Figure 11:
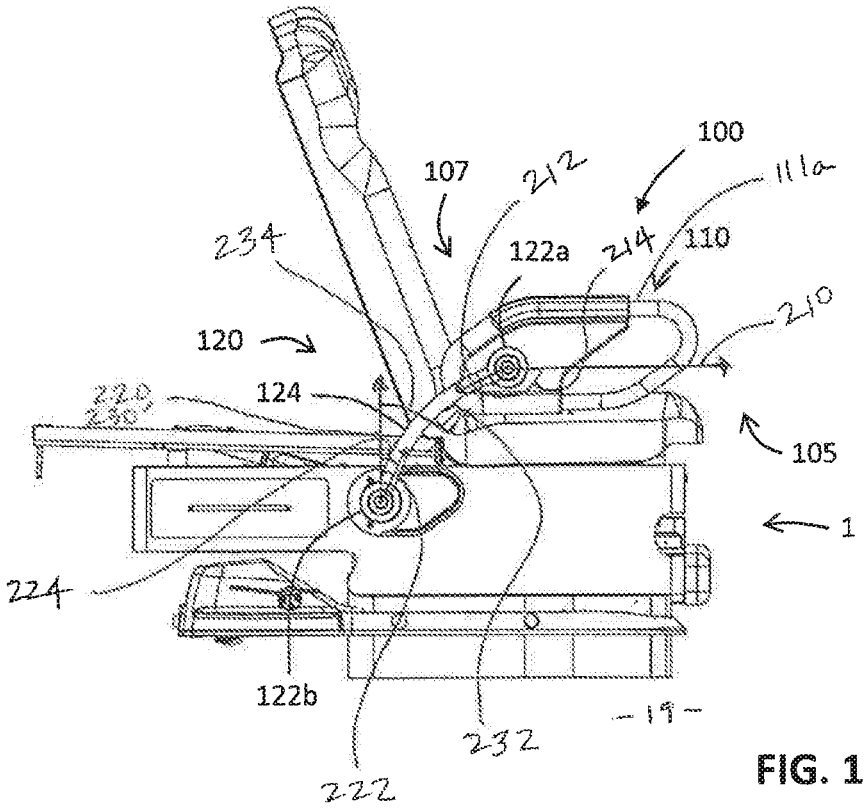
FIG. 11 is a left side elevation of a medical examination device having one embodiment of the arm support assembly, shown in a seated position.

For example, the arm support assembly 100 may be placed in a common seated position as shown in FIG. 11, in which the back of the medical examination device 1 is raised to support the back of a patient in a seated position and the armrest 110 is configured to receive and support the arm of a patient with their forearm extending in a forward direction from the side of their body. This is a very natural position when seated. The back may be at any position relative to the medical examination device 1 as is common for a seated position, such as in the range of 90° to 120°, and in some embodiments may be about 112° to 115°. For instance, the back may be positioned at an angle of about 112° as shown in FIG. 11. In the seated position, the armrest 110 may be positioned parallel to the seat cushion 2 of the medical examination device 1 or procedure chair, and may further be adjacent to the seat cushion 2.

Figure 12:
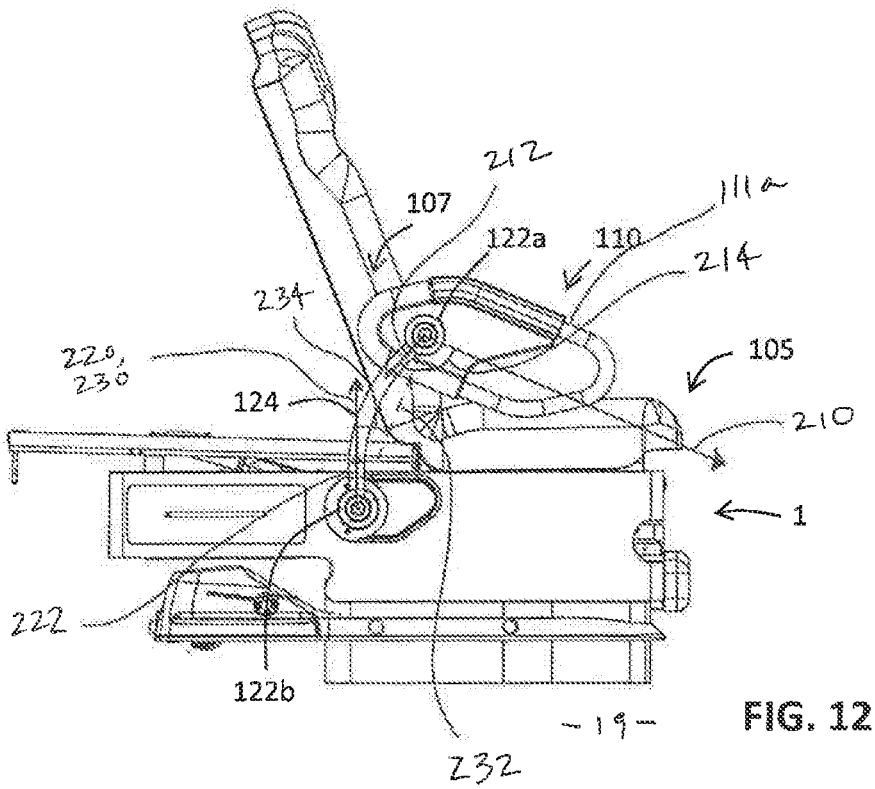
FIG. 12 is a left side elevation of a medical examination device having the arm support assembly of FIG. 11, shown in a blood pressure position.

The arm support assembly 100 is also positionable into a blood pressure position, shown in FIG. 12, in which the forward end 105 of the armrest 110 is lowered and the rearward end 107 is elevated. This corresponds to lowering of the patient's hand and the raising of the elbow, respectively, which positions the arm so the point where a blood pressure cuff is placed to obtain a reading, such as the bicep, is at a height that is at least level with or higher than the heart. This provides optimal positioning for accurate blood pressure readings. Moreover, the patient's arm is fully supported by the armrest 110 in the blood pressure position of FIG. 12, reducing the awkwardness of the position so the patient may relax and a more accurate reading can be obtained.

Figure 13:
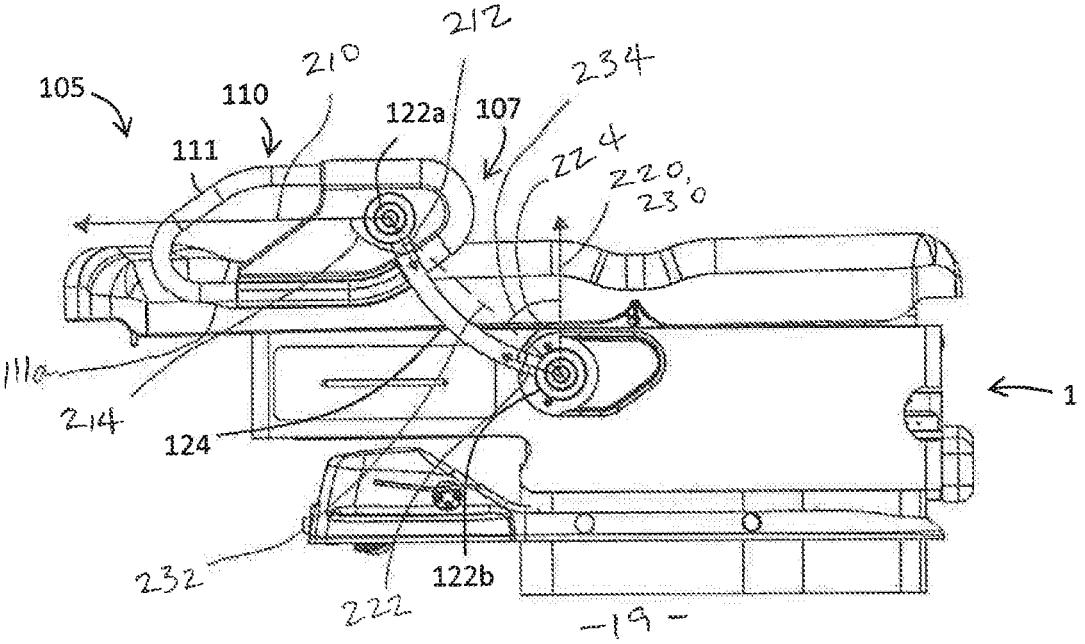
FIG. 13 is a left side elevation of a medical examination device having the arm support assembly of FIG. 11, shown in a supine position.

The arm support assembly 100 may also be adjusted to a lying or supine position, as in FIG. 13. As used herein, "lying position" and "supine position" may be used interchangeably to refer to the same position. In this position, the armrest 110 is positioned at the head of the medical examination device 1, such that is near or adjacent to a patient's head when lying on the device 1. Although described as a "supine" position where a patient may be lying on their back, this position may also be used if the patient is in a prone position on their stomach or lying on one side. It may be horizontal such as parallel to the ground or seat cushion 2 in at least one embodiment, although it may also include deviations from true parallel or horizontal. In this position, the armrest 110 may be positioned with the underside of the armrest 110 receiving the arm of a patient, so that it is upside down relative to in the seated position of FIG. 11. Moreover, in the lying position of FIG. 13, the opening formed in the armrest 110 may be positioned adjacent or near the head of the patient, so the armrest 110 does not obstruct a medical practitioner's access to the patient for examination or performance of procedures. In other embodiments, the armrest 110 may maintain the same orientation in the seated and lying positions, but may simply be shifted more toward the head of the device 1 for the lying position.

Figure 14:
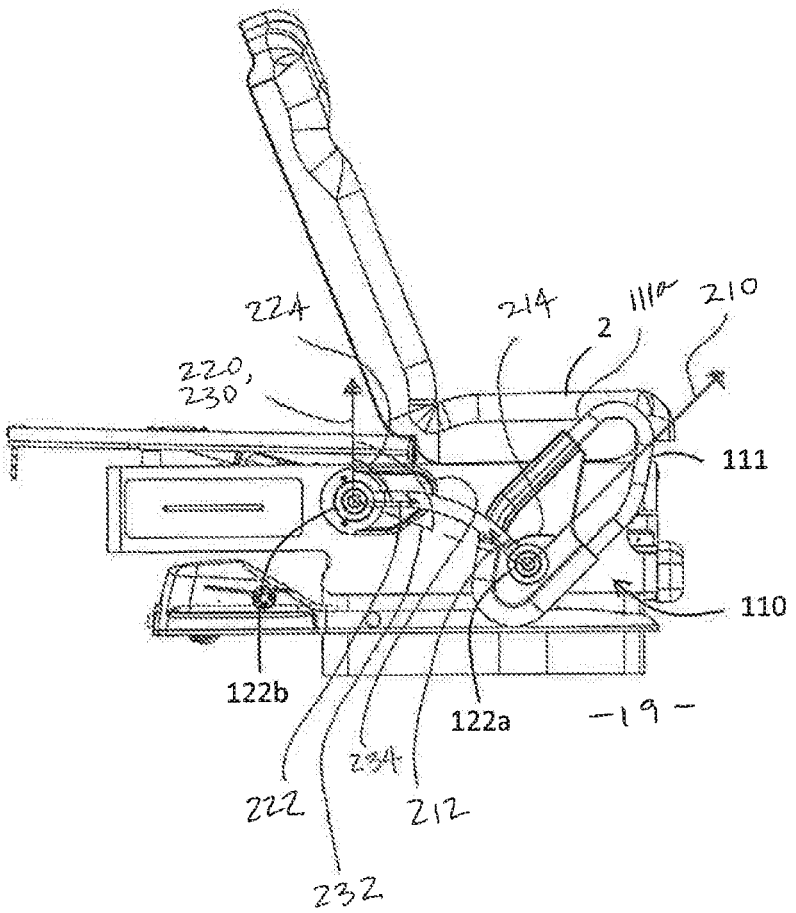
FIG. 14 left side elevation of a medical examination device having the arm support assembly of FIG. 11, shown in a stored or patient transfer position.

The arm support assembly 100 may also be positioned in at least one storage or stowed position, such as shown in FIG. 14. In this position, the armrest 110 is moved below the plane of the seat cushion 2 of the examination device 1 or chair so that a patient may move (or be moved) on and off the examination device 1 or chair unimpeded. Accordingly, the stowed position may also be referred to as a patient transfer position. The armrest 110 may be moved below the plane and parallel to the seat cushion 2, with either the underside or top side of the armrest 110 adjacent to the surface of the seat cushion 2. In at least one embodiment, as shown in FIG. 14, the armrest 110 may be maneuvered below and at an oblique angle relative to the plane of the seat cushion 2. In other embodiments, the armrest 110 may be stored at a right angle to the plane of the seat cushion 2. In certain embodiments, such as depicted in FIG. 14, the armrest 110 may be used by the patient to facilitate their movement onto and off the examination device 1 or chair. For instance, the armrest 110 may be positioned so that the tubing 111 may be gripped by a person and used to pull themselves up or stabilize themselves while getting to their feet or sitting down. This can be particularly useful for people in wheelchairs that often pull up to a medical examination device 1 or chair catty-corner to the seat cushion 2. The armrest 110 positioned as in FIG. 14 is aligned so the tubing 111 is located precisely where many people reach to stabilize themselves in getting out of or into a wheelchair. The armrest 110 is sufficiently rigid and locked in place such that it can support the weight and torque applied by a person in getting up and down between a wheelchair or other chair and the examination device 1 or chair.

The arm support assembly 100 may be maneuvered between various positions, including but not limited to the ones shown in FIGS. 11-14, by selectively adjusting the connecting assembly 120. As is depicted in the figures, the connecting assembly 120 includes a first joint 122*a* connecting to the armrest 110, a second joint 112*b* connecting to the medical examination device 1 or procedure chair (not shown), and an elongate member 124 extending between the first and second joints 122*a*, 122*b*. Each joint 122*a*, 122*b* may be rotated about 360° when unlocked, permitting movement to any of a number of positions. Further, each joint 122*a*, 122*b* is independently operable so that movement or rotation of one joint 122*a*, 122*b* does not cause similar rotation of the other joint. Each joint 122*a*, 122*b* is fixedly secured to one end of the elongate member 124. The elongate member 124 is of rigid construction, such as made of metal, metal alloys, or plastic, and retains its shape under pressure. The elongate member 124 may have any suitable shape, such as curved, linear, angular, curvilinear, arcuate, oblong or any suitable configuration. In the embodiments shown in FIGS. 11-14, for instance, the elongate member 124 is curved or arcuate in shape.

Because the elongate member 124 is of rigid construction and is fixedly secured to each of the joints 122*a*, 122*b*, rotation of the second joint 122*b* causes the elongate member 124 to rotate about the second joint 112*b*, which acts a pivot point. The attached first joint 122*a* is therefore also moved through space concentrically about the second joint 122*b*, brought along by motion of the elongate member 124. In this manner, counterclockwise rotation of the second joint 122*b* from the seated position of FIG. 11 may be used to move the elongate member 124 to a more vertical orientation as shown in blood pressure position of FIG. 12. Further counterclockwise rotation of the second joint 122*b* may cause the elongate member 124 to move toward the head of the medical examination device 1, as in the lying position of FIG. 13. Clockwise (or further counterclockwise) motion of the second joint 122*b* may cause the elongate member 124 to move toward the foot of the examination device 1, as in the stowed or patient transfer position of FIG. 14.

Rotation of the first joint 122*a* may cause the attached armrest 110 to rotate about the first joint 122*a* as a pivot point. The first joint 122*a* may be rotated 360° when unlocked, permitting movement to any of a number of positions. For instance, clockwise rotation of the first joint 122*a* from the seated position of FIG. 11 may cause the armrest 110 to move so the forward end 105 is lowered and the rearward end 107 is elevated, as shown in the blood pressure position of FIG. 12. Counterclockwise rotation around the first joint 122*a* may cause the armrest 110 to be inverted in orientation and positioned at the head of the device 1, as in the lying or supine position of FIG. 13. Counterclockwise rotation around the first joint 122*a* may cause the armrest 110 to rotate relative to the plane of the seat cushion 2 for positioning into the stowed or patient transfer position of FIG. 14.

Accordingly, the first and second joints 122*a*, 122*b* may be independently and selectively actuated to adjust the arm support assembly 110, and specifically the armrest 110, between any number of various possible positions. Coordination of the rotations of first and second joints 122*a*, 122*b*, the resultant movement of elongate member 124 and rotation of the armrest 110 may be utilized to fully maneuver the arm support assembly 100 between and among the various possible positions. The above are but a few exemplary positions and are not intended to be limiting. In further embodiments, at least one of the first and second joints 122*a*, 122*b*, elongate member 124 and armrest 110 may be moved collectively or simultaneously for adjustment and positioning of the arm support assembly 100.

In at least one embodiment, the arm support assembly 100 may also include at least one indicia located anywhere along the surface of the first and second joints 122*a*, 122*b*, elongate member 124 or armrest 110 to assist a medical practitioner, user, patient or other person in identifying, selecting, and confirming positions of the arm support assembly 100. For instance, these indicia may be words, letters, numbers, symbols, lines, shapes, colors, or other marking or combination thereof to denote various different positions. The indicia may be located on any part of the arm support assembly 100, such as but not limited to the surface of the first and second joints 122*a*, 122*b* and armrest 110.

Figure 15:
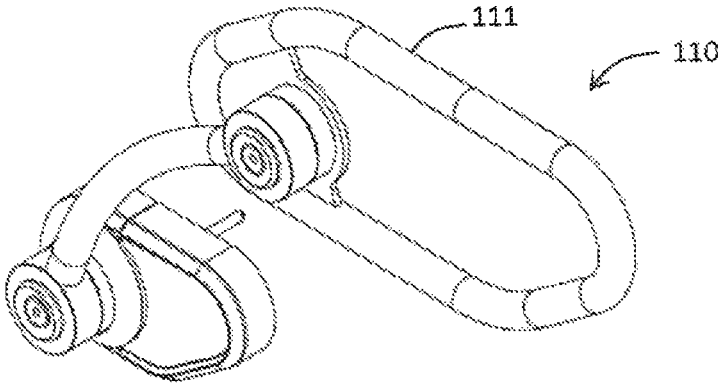
FIG. 15 is an isometric view of a first embodiment of the arm support assembly.
Figure 16:
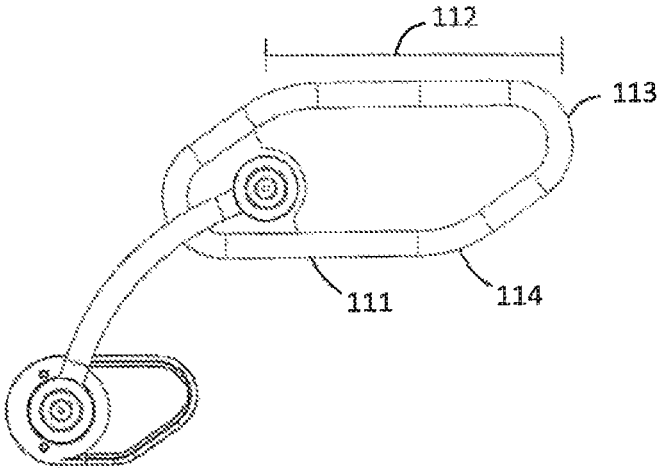
FIG. 16 is a side plan view of the arm support assembly of FIG. 15.
Figure 17:
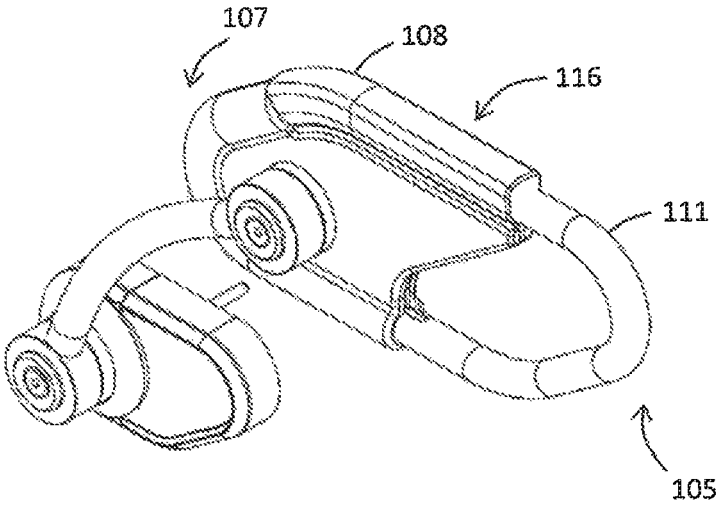
FIG. 17 is an isometric view of a second embodiment of the arm support assembly, also shown in FIG. 11.

Turning now to FIGS. 15-18, the arm support assembly 100 includes an armrest 110 that is configured to receive and support a patient's arm thereon. The arm support assembly 100, and the armrest 110 in particular, conform to the requirements for accessibility of health care equipment under the Americans with Disabilities Act, including the Standards for Accessible Medical Diagnostic Equipment set forth by the United States Access Board and published at 36 CFR Part 1195 (Jan. 9, 2017) (the "Standards"). For instance, in at least one embodiment the armrest 110 may be considered a transfer support per section M305.2 of the Standards and meets the requirements thereof. In at least one embodiment, the armrest 110 may be made of tubing 111 shaped to form an opening, as shown in FIGS. 15-17. The tubing 111 may be of circular or non-circular cross-section, and may have an outer diameter in the range of 1.25 to 2 inches. For instance, in certain embodiments the tubing 111 may have a circular cross-section and an outer diameter of 1.25 inches. The tubing 111 may be made of any suitable material, which is preferably rigid and durable, such as but not limited to steel, aluminum, plastic, metals and metal alloys.

The tubing 111 of the armrest 110 may be formed into any shape as permits the receipt and support of a patient's arm thereon. For instance, in at least one embodiment as shown in FIGS. 11-18, the armrest 110 may comprise a parallelogram shape, having parallel long sides and short sides. The long sides define a length 112 of the armrest 110, which may be in the range of 12 to 28 inches long. In at least one embodiment, the armrest 110 may be 14 to 15 inches long. The parallelogram shape of the armrest 110 may be angular or curved. In at least one embodiment, the armrest 110 may be a curved parallelogram defined by the bend radii of first and second bends 113, 114 that form the curves thereof. For instance, the tubing 111 of the armrest 110 may include first bends 113 having a smaller bend radius than second bends 114, where the first and second bends 113, 114 are alternated in the tubing 111 to form a parallelogram shape. In a preferred embodiment, the first bends 113 may have the same bend radius as one another, although in other embodiments they may have different bend radii. The first bends 113 may have a bend radius in the range of 1.5 to 3.0 inches, measured as a center line radius measuring from the center of the tubing 111 rather than an outer or inner perimeter. In at least one embodiment, the first bends 113 may have a center line bend radius of 2.5 inches. The second bends 114 have a larger bend radius than the first bends 113. In a preferred embodiment, the second bends 114 may have the same bend radius as one another, although in other embodiments they may have different bend radii. In some embodiments, the second bends 114 have a center line bend radius of 3.0 to 7.0 inches. In at least one embodiment, the second bends 114 may have a center line bend radius of 6.0 inches.

The armrest 110 also includes a joint plate 121*a* secured between portions of the tubing 111. In at least one embodiment, the joint plate 121*a* is made of the same material as the tubing 111, and may be welded, soldered, bonded, or otherwise affixed to the tubing 111. In some embodiments, the joint plate 121*a* may be formed of a unitary construction with the tubing 111, such as in the case of mold or die casting, compression or injection molding, or 3D printing. In at least one embodiment, the joint plate 121*a* spans between portions of the tubing 111. The joint plate 121*a* is configured and dimensioned to receive and retain the first joint 122*a* thereto, and accordingly may be at least the size and shape of the first joint 122*a*.

Figure 18:
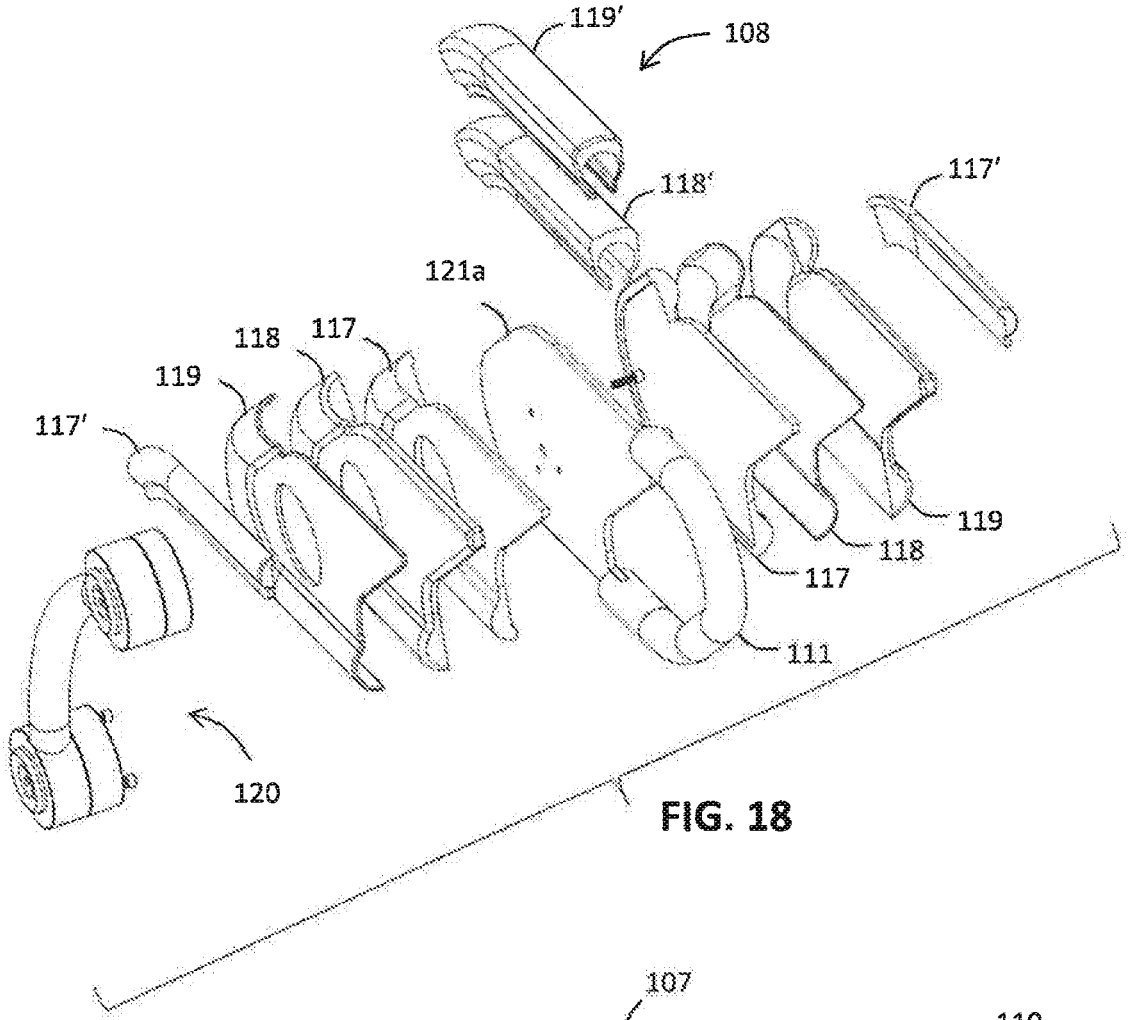
FIG. 18 is an exploded view of the armrest of the arm support assembly of FIG. 17.

In certain embodiments, as shown in FIGS. 17-18, the armrest 110 may also include padding 116 that covers at least a portion of the armrest 110. For instance, as shown in FIGS. 17-18 the padding 116 may cover at least a portion of the tubing 111, such as along the rearward end 107. Preferably, the padding 116 covers more than just the tubing 111, and may span at least a portion of the opening formed in the armrest 110, as shown in FIG. 17. The padding 116 is made of pliable, at least partially compressible and preferably resilient material to provide cushioning support to a patient's arm or hand when placed thereon. In at least one embodiment, the padding 116 may be integrally formed with the armrest 110 or may be permanently affixed to the armrest 110 at the manufacturer. In other embodiments, the padding 116 may be removable and may be selectively attached and removed, such as with a zipper, hook and loop fastener, buttons, snaps, or other selective type fastener. In some embodiments, the padding 116 may be slidingly positioned or otherwise positionable in covering engagement over at least a portion of the armrest 110.

The padding 116 may have a composite structure, such as shown in the exploded view of FIG. 18, in which various layers make up the padding 116. For instance, the padding 116 may include a substrate 117 such as wood or plastic, which is rigid and retains its shape. This substrate 117 may be secured to the surface(s) of the joint plate 121*a*, at least to the areas not contacted by the first joint 122*a*. The padding 116 may further include at least one compliant material 118 that may be pliable, at least partially compressible and preferably resilient to provide cushioning support to the padding 116. For instance, in at least one embodiment the compliant material 118 may be foam, cotton, synthetic fibers, rubber, gels, liquids, and other suitable materials. There may be more than one compliant material 118 present in the padding 116, which may be the same type or different types from one another. The compliant material 118 is secured to the substrate 117, such as by adhesive or friction.

The padding 116 may further include upholstery 119 comprising the exterior of the padding 116. The upholstery 119 may be any material suitable for contact with skin, such as but not limited to cloth, leather, imitation leather, synthetic fibers and microfiber. The upholstery 119 may contact the compliant material 118 on one side and be configured to receive the arm or hand of a patient on the other side. Accordingly, the upholstery 119 may present the exterior surface of the padding 116 and may be secured to at least one of the compliant material 118, substrate 117 and joint plate 121*a* to secure the padding 116 together.

In at least one embodiment, the padding 116 may further include a top cushion 108 to provide additional support for a patient's arm. The top cushion 108 may be positioned along the top surface of the armrest 110, and may be in addition to the padding 116 already present in the armrest. The top cushion may be made of similar layers of substrate 117', compliant material 118' and upholstery 119', which may be the same or different than that used in the rest of the padding 116. The top cushion 108 may be made by separate sub-assembly, as shown in FIG. 18, and may be added to the padding 116 of the armrest 110. In other embodiments, the top cushion 108 may be formed with the rest of the padding 116. Some embodiments may not include a top cushion 108, and still further embodiments may contain no padding 116.

Figure 19:
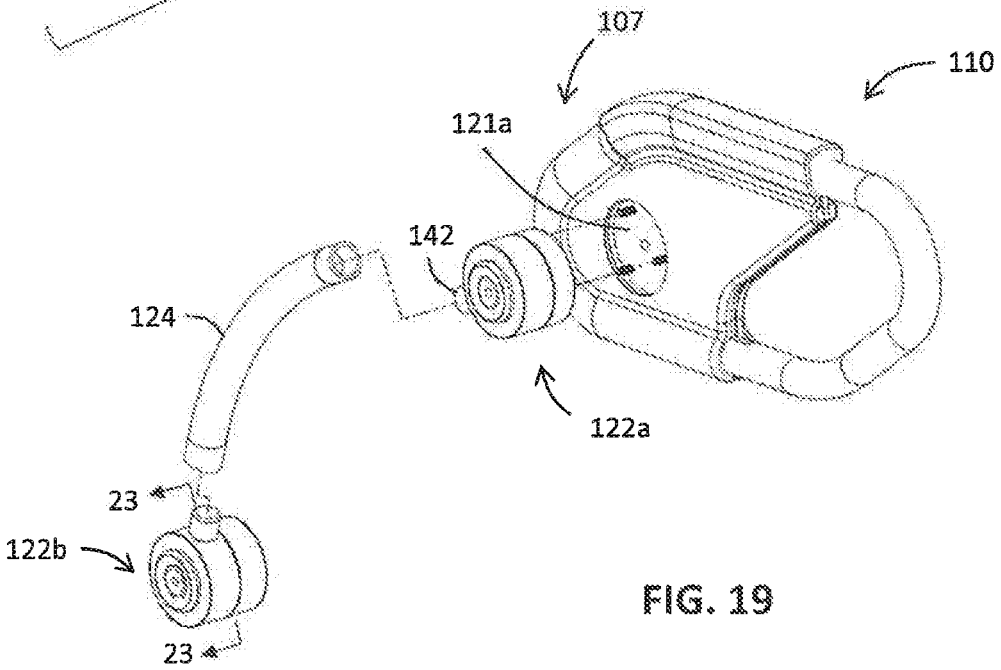
FIG. 19 is a partially exploded view of one embodiment of the connecting assembly and armrest.

As shown in FIG. 19, the joint plate 121*a* of the armrest 110 receives and retains the first joint 122*a* of the connection assembly 120. For instance, the first joint 122*a* may be secured to the surface of the joint plate 121*a*, such as with screws, bolts, pins, adhesives or other suitable fasteners. The joint plate 121*a* may be located at any position along the armrest 110. In at least one embodiment, the joint plate 121*a* is located at the rearward end 107 of the armrest 110, as shown in FIG. 19. Accordingly, the first joint 122*a* may connect to the armrest 110 anywhere along the armrest 110, such as at the rearward end 107 thereof, and the opposite end such as the forward end 105 may be cantilevered. One end of the elongate member 124 is affixed or secured to the first joint 121*a*. The opposite end of the elongate member 124 is affixed or secured to the second joint 122*b*. The elongate member 124 may be secured to the first and second joints 122*a*, 122*b* such as by welding, soldering, bonding, adhesive, or other similar method of connection. In at least one embodiment, the elongate member 124 and first and second joints 122*a*, 122*b* may be formed of a unitary construction, such as but not limited to by mold or die casting, compression or injection molding, or 3D printing.

Figure 20:
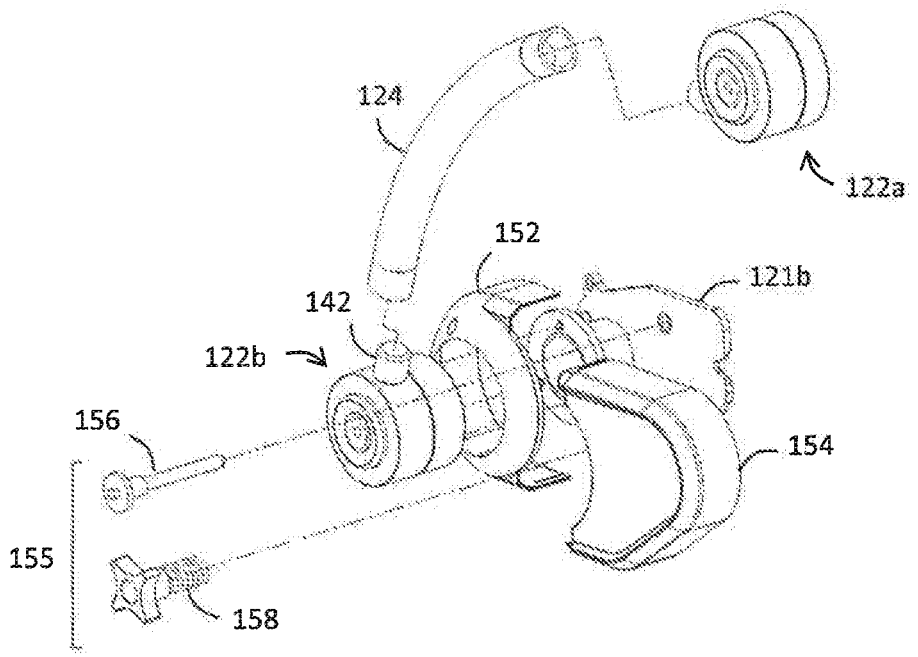
FIG. 20 is a partially exploded view of one embodiment of the connecting assembly and device attachment mechanism.

As shown in FIG. 20, the second joint 122*b* secures to a joint plate 121*b*, such as by screws, bolts, pins, adhesives or other suitable fasteners. The joint plate 121*b* may have the same or different configuration, dimensions, and material as the joint plate 121*a*, and may be substantially planar in at least one embodiment. The joint plate 121*b* is in turn secured to the medical examination device 1 or procedure chair, such as with an attachment mechanism 155.

In at least one embodiment, the attachment mechanism 155 may include at least one of a first connection member 156 and second connection member 158. The first connection member 156 may be a pin that is insertable into a correspondingly configured receptacle in the side of the medical examination device 1, and the second connection member 158 may be a bolt or knob that rotates to threadingly engage a corresponding hole or aperture in the side of the medical examination device 1. In some embodiments, the first and second connection members 156, 158 may coordinate to collectively attach the joint plate 121*b* to the medical examination device 1 or procedure chair. Accordingly, the arm support assembly 100 may be selectively secured to and removed from the medical examination device 1 or procedure chair by attaching or detaching the attachment mechanism 155. The attachment mechanism 155 may be of the type already used in the medical industry to attach armrests or other components to the side of medical examination devices 1. Accordingly, the attachment mechanism 155 may be used to retrofit the arm support assembly 100 of the present invention onto pre-manufactured medical examination devices 1. In some embodiments, however, the second joint 122*b* may connect directly to the side of the medical examination device 1 without the use of a joint plate 121*b*.

Figure 21:
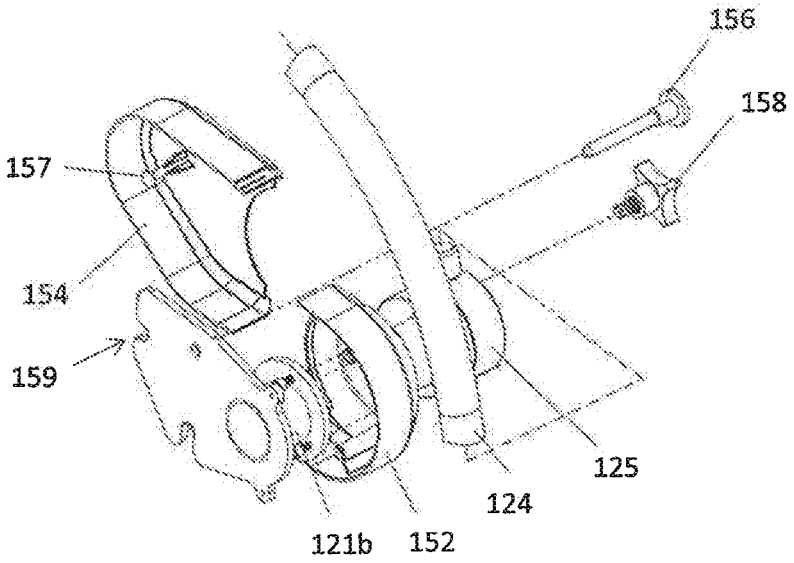
FIG. 21 is a partial exploded view of the shroud, device attachment mechanism and second joint of the arm support assembly

The second joint 122*b* may also include a shroud 150 dimensioned and configured to cover at least a portion of the second joint 122*b* and/or the joint plate 121*b* from view. In some embodiments the shroud 150 may protect the attachment mechanism 155 from accidental removal or loosening. In at least one embodiment, the shroud 150 may include a first shroud section 152 and a second shroud section 154. The first shroud section 152 may be secured to at least one of the second joint 122*b* and joint plate 121*b* to provide an anchor point for the shroud 150. The second shroud section 154 may be removably secured to the first shroud section 152, allowing for selective access to the joint plate 121*b* and attachment mechanism 155 for easy attachment, maintenance and removal. In at least one embodiment, the second shroud section 154 may be slidable relative to the first shroud section 152, although in other embodiments the second shroud section 154 may simply be positioned in contact with the first shroud section 152 for attachment. The first and second shroud sections 152, 154 may be releaseably secured together such as by snap fit, mating components, lip and groove connections, and other similar methods of releasable attachment, where one component is located on the first shroud section 152 and the mating connection component is located on the second shroud section 154. The second shroud section 154 may further include a spacer 157 configured to span at least part of the distance between the second shroud section 154 and the joint plate 121*b* or side of the medical examination device 1. In at least one embodiment, the spacer 157 may be configured to extend from an inner surface of the second shroud section 154 toward the joint plate 121*b* or side of the medical examination device 1. The spacer 157 is dimensioned to be at least the same length as portion of the attachment mechanisms 155 that extends from the surface of the medical examination device 1 or procedure chair. Accordingly, the spacer 157 is configured to provide structural support to the second shroud section 154 while also preventing damage to or accidental loosening of the attachment mechanism 155 during placement and removal of the second shroud section 154. In at least one embodiment, the joint plate 121*b* may include a groove 159, as shown in FIG. 21, that is dimensioned to receive and retain a portion of the spacer 157, such as an enlarged head thereof, to facilitate alignment and securing of the second shroud section 154 in place.

Each of the first and second joints 122*a*, 122*b* includes a housing 125 and a rotary mechanism 123 configured to permit selective rotary motion of at least one portion of the first or second joints 122*a*, 122*b*. The component parts of the housing 125 and rotary mechanism 123 will be described in connection with one of the joints, but it should be understood that this description applies equally to each of the first and second joints 122*a*, 122*b*. The rotary mechanism 123 may be similar to that described in U.S. Pat. Nos. 5,689,999 and 5,586,363, the contents of both of which are incorporated by reference herein in their entireties.

Figure 22:
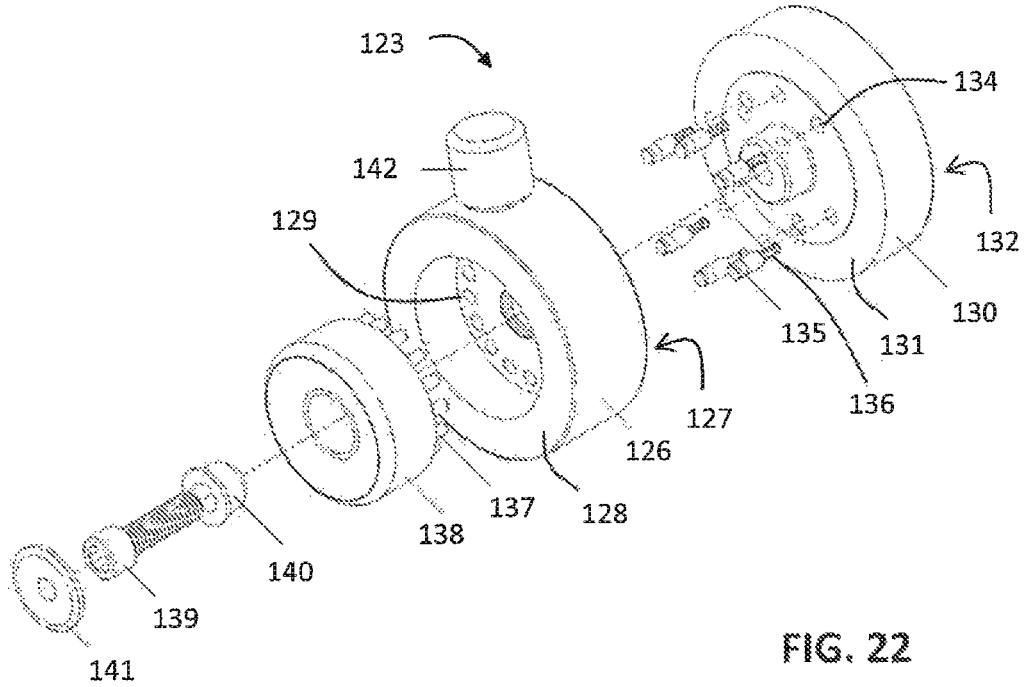
FIG. 22 is an exploded view of a joint of the arm support assembly.
Figure 23:
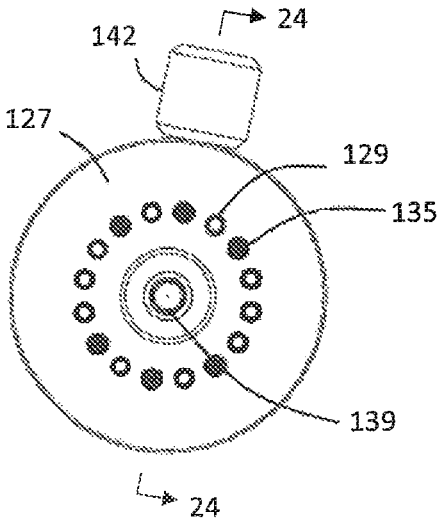
FIG. 23 is a plan view along the first surface of the first housing of a joint, shown along line 23-23 from FIG. 19.
Figure 24:
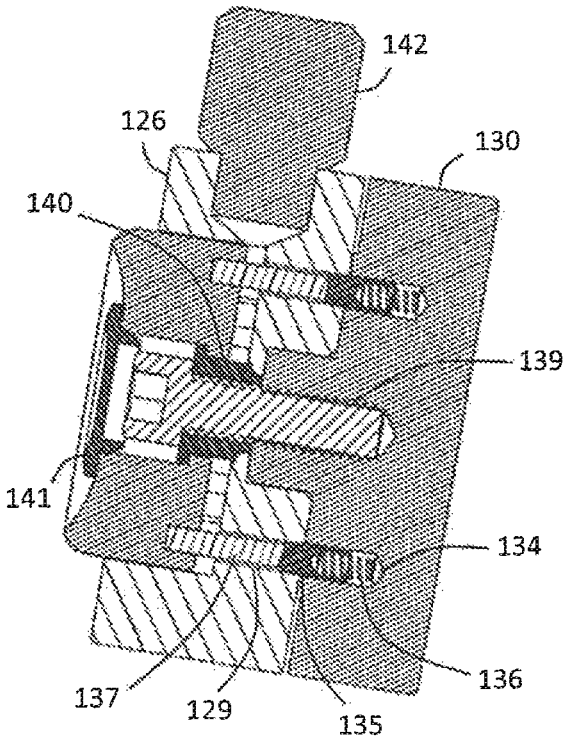
FIG. 24 is a cross-sectional view of an assembled joint along line 24-24 from FIG. 23.

Turning now to FIGS. 22-24, each joint 122*a*, 122*b* includes a housing 125 dimensioned and configured to retain the various components of the rotary mechanism 123. The housing 125 may include a first housing portion 126 with a first surface 127 and opposite second surface 128, and a second housing portion 130 with a first surface 131 and opposite second surface 132. The first and second housing portions 126, 130 may be fitted together to form the composite housing 125. The first surfaces 127, 131 of each are positioned in facing, contacting, abutting, and/or adjacent relation to one another in the composite housing 125. Accordingly, the first surfaces 127, 131 may also be referred to as interior surfaces of the first and second housing portions 126, 130, respectively. Second surfaces 128, 132 may therefore be referred to as exterior surfaces of the first and second housing portions 126, 130, respectively.

In at least one embodiment, the first surfaces 127, 131 face each other and may contact one another. This contact may be a sliding contact that allows for rotary movement of the first surfaces 127, 131 relative to one another as their respective first and second housing portions 126, 130 are rotated relative to one another. In certain embodiments, the first surfaces 127, 131 may not necessarily contact one another, but may be adjacent to one another in close proximity. This configuration may allow for a small space between the first surfaces 127, 131 to permit rotational movement of the first and second housing portions 126, 130 relative to one another without damaging the first surfaces 127, 131. In still other embodiments, the first surfaces 127, 131 may contact one another at certain times, such as when the rotary mechanism 123 is in a locked position and may be spaced apart from one another at other times, such as when the rotary mechanism 123 is in an unlocked position.

The first housing portion 126 may further include a plurality of channels 129 extending therethrough between the first and second surfaces 127, 128. These channels 129 preferably have the same dimensions and are parallel to one another, but in certain embodiments may have different dimensions from one another and may be at angles relative to one another, such as oblique angles. The channels 129 may form any configuration within the first housing portion 126. In at least one embodiment, the channels 129 are collectively form a circular configuration, as shown in FIGS. 22 and 23. There may be any number of channels 129, such as 6 to 20 in some embodiments. In certain embodiments, there may be 16 channels 129 in the first housing portion 126. In at least one embodiment, the channels 129 may uniformly spaced apart from one another, as in FIG. 23. In other embodiments, certain channels 129 may be spaced closer or further from other channels 129. This spacing may be described as angular spacing. For instance, adjacent channels 129 may be spaced in the range of 10° to 80° relative to one another. In some embodiments, they may be spaced 20° to 30° relative to one another. In at least one embodiment, as shown in FIG. 23, adjacent channels 129 may be spaced 22.5° from one another.

The second housing portion 130 may include a plurality of receivers 134 each defining a space formed in the second housing portion 130 and extending from the interior-facing first surface 131 thereof, as shown in FIG. 22. There may be any number of receivers 134 formed in the second housing portion 130, and they may be presented in any configuration. For instance, in the embodiment if FIG. 22, the receivers 134 may collectively form a circular configuration, and there may be 6 receivers. In other embodiments, there may be 2 to 20 receivers. The receivers 134 may be uniformly spaced from one another, or certain ones may be spaced closer or further apart from one another. The receivers 134 may be disposed at angles relative to one another or may be parallel to one another. In at least one embodiment, the angles of the receivers 134 in the second housing portion 130 may correspond with the angles of the channels 129 in the first housing portion 126 when the portions 126, 130 are joined.

Each receiver 134 is dimensioned to receive a locking member 135 and biasing element 136 therein. The locking members 135 may be a pin, rod, or other elongate device that has a rigid construction. The locking members 135 may be made of any suitably rigid material that does not deform under pressure, such as but not limited to plastic, metal, metal alloys and wood. The biasing elements 136 may be any biasing structure, such as but not limited to springs, coils, or other structure capable of transforming to absorb, retain, and release energy. In some embodiments, such as depicted in FIGS. 22 and 24, each receiver 134 includes a biasing element 136 mounted at a terminal end thereof and a locking member 135 is slidingly received therein and abuts against the biasing element 136. The biasing element 136 exerts a biasing force on the locking member 135. The opposite end of the locking member 135 projects from the receiver 134 and extends beyond the first surface 131 of the second housing portion 130. In other embodiments, some of the receivers 134 include a biasing element 136 and locking member 135, whereas other receivers 134 remain empty. The pattern or configuration of locking members 135 disposed in receivers 134 and extending from the first surface 131 of the second housing portion 130 may be referred to as the "clocking" of the joint 122*a*, 122*b*. Accordingly, there may be any number of locking members 135 disposed in the receivers 134. In at least one embodiment as shown in FIGS. 22-23, there may be six locking members 135 clocked in groupings of three, although any pattern, configuration, number and grouping is contemplated. In some embodiments, the clocking may be described in terms of numbers of locking members 135, groupings of locking members 135 or the angular spacing between adjacent locking members 135. For instance, the clocking may be described as in the range of 10° to 60°. In some embodiments, the clocking may be at 20° to 30°. In certain embodiments, as in FIG. 23, the clocking may be 45°. Further, the torque-bearing strength of the joint 122*a*, 122*b* may be directly proportional to at least one of the number and clocking of locking members 135. For instance, greater numbers of locking members 135 may provide greater resistance to torque or rotational motion, and therefore stronger locking action, as will be described in greater detail below. Lower angular clocking values may indicate adjacent locking members 135 are in closer proximity to one another, also increasing the strength of the locking action.

Each locking member 135 is also dimensioned to fit within and be slidingly received by at least one channel 129 of the first housing portion 126, as shown in FIG. 24. The locking members 135 extend into different ones of the channels 129 in a locked position, as shown in FIGS. 23 and 24. The biasing force from the biasing element 136 may push the corresponding locking member 135 in the direction of the channels 129, and when a locking member 135 is aligned with a channel 129 it is received therein. A locking position may be defined by at least one locking member 135 disposed within or extending into a correspondingly aligned channel 129. In at least one embodiment, a locking position may be defined when all the locking members 135 are retained within their own respective channels 129, as in FIG. 23. Accordingly, there may be at least as many channels 129 as there are locking members 135. There may be any number of possible locked configurations, limited only by the number of channels 129 and locking members 135. In at least one embodiment, as in FIG. 23, each channel 129 is dimensioned to retain any of the locking members 135 such that different locking members 135 may be received and retained within the same channel 129 in different locking positions.

Each joint 122*a*, 122*b* may also include a plurality of release members 137, each dimensioned to fit within and be slidingly received by a corresponding one of the channels 129 of the first housing portion 126. The release members 137 may have an elongate dimension and in at least one embodiment have the same length as the dimension of the first housing portion 126. There may be any number of release members 137, although in at least one embodiment there are the same number of release members 137 as there are channels 129. As seen in FIG. 24, each channel 129 may be configured to slidingly receive and retain both a release member 137 from one side and a locking member 135 from the opposite side. However, each channel 129 need not have both a release member 137 and locking member 135 at the same time, even in a locked position. Some channels 129 will only have a release member 137 disposed therein when locked, depending on whether or not a locking member 135 was aligned with the particular channel 129.

The joint 122*a*, 122*b* may also include an actuator 138 to control the rotary mechanism 123 and whether it is in a locked or unlocked position. The actuator 138 may be configured to at least contact, if not receive, retain or secure, each of the release members 137. As shown in FIG. 22, the actuator 138 may be dimensioned to fit within a recess in the first housing portion 126. The actuator 138 may be depressed, pressed, pushed, or otherwise activated or engaged to select between unlocked and locked states of the rotary mechanism 123. Accordingly, the actuator 138 may be a button or other like structure.

When the actuator 138 is not engaged, the locking members 135 are retained within correspondingly aligned channels 129 and the rotary mechanism 123 is in a locked position. When the actuator 138 is activated, it presses on the release members 137, pushing them into the channels 129 to the furthest extent possible which is defined by the terminal ends of the release members 137 being flush, co-terminal or even with the first surface 127 of the first housing portion 126. The release members 137 that co-reside in a channel 129 with a locking member 135 push on the locking member 135 as they move, forcing the corresponding locking members 135 out the channels 129. Once the locking members 135 are no longer retained within the channels 129, the rotary mechanism 123 is in an unlocked position and the first and second housing portions 126, 130 are freely rotatable relative to one another, such as about an axle 139 that may extend through at least the first and second housing portions 126, 130, but preferably through the entire joint 122*a*, 122*b*. A bearing 140 may also be concentrically disposed around at least a portion of the axle 139 to reduce friction and facilitate smooth rotational motion of the first and second housing portions 126, 130 relative to one another. An end cap 141 may cover the end of the axle 139 and a portion of the actuator 138 to protect the rotary mechanism 123 and facilitate the activation of the actuator 138.

The housing 125 may include an extension 142 extending radially outwardly from at least one of the first and second housing portions 126, 130. In at least one embodiment, the extension 142 extends from the first housing portion 126, as in FIGS. 22-24. The extension 142 may be formed integrally with the housing portion(s) 126, 130, or may be secured or mounted thereto. The elongate member 124 of the connecting assembly 120 mounts to, is secured to, or is integrally formed with the opposite end of the extension 142 from the housing 125, such that the extension 125 forms the connection point between the elongate member 124 and the housing 125 of a joint 122*a*, 122*b*. Accordingly, when the rotary mechanism 123 is in an unlocked position, the elongate member 124 of the connecting assembly 120 may be moved to rotate the first and second housing portions 126, 130 of the first joint 122*a* or second joint 122*b* relative to one another. Similarly, the armrest 110 may be maneuvered in an unlocked position to rotate the first and second housing portions 126, 130 of the first joint 122*a* relative to one another in an unlocked position to move the armrest 110.

Activation or engagement of the actuator 138 is maintained until the desired position is achieved for the armrest 110 and/or elongate member 124, at which point the pressure is removed from the actuator 138. As pressure is released, release members 137 correspondingly slide through the channels 129 in the direction of the actuator 138, leaving a space in each of the channels 129 at the first surface 127. The biasing elements 136 pushing against the locking members 135 force the locking members 135 toward the channels 129. If the locking members 135 are aligned with channels 129, the biasing force of the biasing element 136 pushes the locking members 135 into the space of the aligned channels 129 vacated by the retreating release members 137. Once at least one of the locking members 135 enters the correspondingly aligned channel 129, the rotary mechanism 123 is in a locked position and further rotational motion of the first and second housing portions 126, 130 is precluded, as in FIG. 23. However, if the locking members 135 are misaligned with the channels 129 upon deactivation or disengagement of the actuator 138, the locking members 135 may contact or press against the first surface 127 of the first housing portion 126. This may not result in a locked position, but it may make rotational motion more difficult. In at least one embodiment, the first and second housing portions 126, 130 will continue to be rotationally movable relative to one another until the locking members 135 become aligned with channels 129, at which point they will slip into the correspondingly aligned channels and a locking position is achieved.

Now that the connection assembly 120 and the rotary motion of the first and second joints 122*a*, 122*b* has been described in detail, various illustrative locked positions shown in FIGS. 11-14 and discussed previously may now be further described. For instance, the various locked positions may be defined by the angle of rotation of each or a combination of the first and second joints 122*a*, 122*b*. The elongate member 124 and armrest 110 may be selectively positioned relative to one another by rotation of the first joint 122*a* to a position defined by a first included angle 214. The first included angle 214 is the smaller angle formed between a longitudinal axis 210 extending from the center of the first joint 122*a* toward the forward end 105 of the armrest 110, and a first measured ray 212 extending from the center of the first joint 122*a* radially outwardly therefrom at the point where the elongate member 124 meets or is secured to the first joint 122*a*. In the seated position of FIG. 11, the first included angle 214 may be in the range of 135° to 170°, and in some embodiments be about 157°. In the blood pressure position of FIG. 12, the first included angle 214 may be in the range of 100° to 120°, and in some embodiments may be about 110°. In the supine position of FIG. 13, the first included angle 214 may be in the range of 105° to 125°, and in some embodiments may be about 116°. In the stowed position of FIG. 14, the first included angle 214 may be in the range of 80< to 100°, and in some embodiments may be about 90°.

Similarly, elongate member 124 and medical examination device 1 may be selectively positionable relative to one another by rotation of the second joint 122*b* to a position defined by a second included angle 224. The second included angle 224 is the smaller angle formed between a reference ray 220 extending radially outwardly from the center of the second joint 122*b* in the direction normal or perpendicular to a supporting surface 19 on which the medical examination device 1 rests, such as ground or floor, and a second measured ray 222 extending from the center of the second joint 122*b* radially outwardly at point where the elongate member 124 meets or is secured to the second joint 122*b*. For instance, in the seated position of FIG. 11, the second included angle 224 may be in the range of 5° to 20°, and in some embodiments be about 12°. In the blood pressure position of FIG. 12, the second included angle 224 may be in the range of 350° to 10°, and in some embodiments may be about 0°. In the supine position of FIG. 13, the second included angle 224 may be in the range of 55° to 85°, and in some embodiments may be about 68°. In the stowed position of FIG. 14, the second included angle 224 may be in the range of 80° to 100°, and in some embodiments may be about 90°.

The various locked positions may be described in terms of the first and second included angles 214, 224 independently, or in combination with one another. For instance, a locked position may be defined When the first included angle 214 is any angle in the ranges of 135° to 170°, 100° to 120°, 105° to 125°, and 80° to 100°. In at least one preferred embodiment, the first included angle 214 may be one of about 157°, 110°, 116°, and 90°. Locked positions may also be defined when the second included angle 224 is any angle in the ranges of 5° to 20°, 350° to 10°, 55° to 85°, and 80° to 100°. In at least one preferred embodiment, the second included angle 224 is one of about 12°, 0°, 68°, and 90°. Any possible combination of the above first and second included angles 214, 224 is also contemplated and may define different locked positions. For instance, in at least one embodiment, locked positions may be defined where the first included angle 214 is any angle in the ranges of 135° to 170°, 100° to 120°, 105° to 125°, and 80° to 100°, and the second included angle 224 is any angle in the ranges of 5° to 20°, 350° to 10°, 55° to 85°, and 80° to 100°. Locked positions may also be defined when the first included angle 214 is one of about 157°, 110°, 116°, and 90°, and the second included angle 224 is one of about 12°, 0°, 68°, and 90°.

In some embodiments, the seated position of FIG. 11 may be defined by a first included angle 214 being any angle in the range of 135° to 170° and the second included angle 224 being any angle in the range of 5° to 20°. In some embodiments, it may be defined as the first included angle 214 being about 157° and the second included angle 224 being about 12°. The blood pressure position of FIG. 12 may be described as the first included angle 214 being any angle in the range of 100° to 120° and the second included angle 224 being any angle in the range of 350° to 10°. In some embodiments, it may be defined as the first included angle 214 being about 110° and the second included angle 224 being about 0°. The supine position of FIG. 13 may be defined as the first included angle 214 being any angle in the range of 105° to 125° and the second included angle 224 being any angle in the range of 55° to 85°. In some embodiments, it may be described as the first included angle 214 being about 116° and the second included angle 224 being about 68°. The stowed position of FIG. 14 may be described as the first included angle 214 being any angle in the range of 80° to 100° and the second included angle 224 being any angle in the range of 80° to 100°. In some embodiments, it may be defined as the first included angle 214 being about 90° and the second included angle 224 being about 90°.

The various locked positions may also be defined or described in terms of the overall angle of the connection assembly 120, as measured by a connection line 232 extending between the center of the first and second joints 122*a*, 122*b*. Because the second joint 122*b* remains fixed in space since it is secured to the medical examination device 1, rotation of the first and/or second joints 122*a*, 122*b* and elongate member 124 results in the first joint 122*a* moving concentrically about the second joint 122*b* in space, where the elongate member 124 acts as a radius. The position of the connection line 232 in any locked position may be compared to a reference line 230 for the connection assembly 120, which may be defined as normal or perpendicular to the supporting surface 19 under the medical examination device 1 and extending through the center of the second joint 122*b*. A displacement angle 234 is formed by the intersection of the reference line 230 and connection line 232, and provides angular positioning information of the connection assembly 120 overall in any of the various locked positions. For instance, the seated position of FIG. 11 may be defined by the displacement angle 234 being any angle in the range of 35° to 55°, and in some embodiments may be about 46°. The blood pressure position of FIG. 12 may be defined by the displacement angle 234 being any angle in the range of 10° to 30°, and in some embodiments may be about 20°. The supine position of FIG. 13 may be defined by the displacement angle 234 being any angle in the range of 300° to 320°, and in some embodiments may be about 313°. The stowed position of FIG. 14 may be defined by the displacement angle 234 being any angle in the range of 100° to 120°, and in some embodiments may be about 111°. As noted above, the various locked positions shown in FIGS. 11-44 are illustrative, and any number of locked positions may be possible for each of the first and second joints 122*a*, 122*b*.

Since many modifications, variations and changes in detail can be made to the described preferred embodiments, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. A leg support assembly for a medical examination device having a cavity and a seat cushion, said leg support assembly comprising:

a first end and an opposite second end;

at least one track having a length extending between said first and second ends and including a horizontal section, an inclined section and a detent;

a frame movably secured to said at least one track and slidingly movable relative thereto, said frame having a first guide member and a second guide member extending therefrom, said first and second guide members configured to contact and be movable along said at least one track, said frame further configured to support a leg pad having an upper surface; and said frame movable between:

(i) a stowed position defined by said leg support assembly retained within said cavity of said medical examination device, and (ii) a deployed position defined by said upper surface of said leg pad disposed substantially co-planar with at least a portion of said seat cushion of said medical examination device;

wherein one of:

a. said stowed position is further defined by said first and second guide members retained along said horizontal section of at least one track, and b. said deployed position is further defined by said first guide member retained within said detent and said second guide member retained along said horizontal section of said at least one track.

2. The leg support assembly of claim 1, wherein said inclined section is co-extensive with said horizontal section at one end and said detent at an opposite end.

3. The leg support assembly of claim 1, wherein said first guide member is movable along said horizontal section, said inclined section, and said detent of said slot, and wherein said second guide member remains in said horizontal section.

4. The leg support assembly of claim 1, wherein each of said first and second guide members is at least one of slidingly movable and rotatably movable relative to said at least one track.

5. The leg support assembly of claim 4, wherein each of said first and second guide members is selected from the group consisting of a pin, rod, roller, wheel, bolt and bearing.

6. The leg support assembly of claim 1, wherein said frame further comprises an attachment member configured to interconnect said leg pad to said frame.

7. The leg support assembly of claim 6, wherein said leg pad includes a spacer assembly and said attachment member includes at least one extension dimensioned to engage said spacer assembly.

8. The leg support assembly of claim 7, wherein said spacer assembly further comprises a plurality of buffers collectively defining a space therein configured to receive and retain said at least a portion of said extension of said attachment member.

9. The leg support assembly of claim 1, wherein said first end of said leg support assembly remains within a plane defined by a terminal end of said seat cushion in said stowed position.

10. The leg support assembly of claim 1, wherein said frame is configured to support said leg pad at an angle relative to said at least one track.

11. The leg support assembly of claim 10, wherein a first angle of said leg pad relative to said horizontal section of said at least one track in said stowed position is substantially equivalent to a second angle formed by the line between said first and second guide members in said deployed position relative to said horizontal section of said track.

12. The leg support assembly of claim 11, wherein said first and second angles are each less than 90 degrees.

13. The leg support assembly of claim 12, wherein said first and second angles are each in the range of 2 to 20 degrees.

14. The leg support assembly of claim 13, wherein said first and second angles are each 13.5 degrees.

15. The leg support assembly of claim 1, wherein a first vertical displacement of said leg pad between said stowed and deployed positions is greater than a second vertical displacement of said first guide member between said stowed and deployed positions.

16. The leg support assembly of claim 15, wherein the ratio of said first and second vertical displacements is in the range of 1.5 to 10.

17. The leg support assembly of claim 16, wherein said ratio is 3.9.

18. The leg support assembly of claim 1, further comprising a slide mechanism configured to facilitate the movement of said leg pad between a first deployed position defined by said leg pad being spaced apart a predetermined distance from said seat cushion of said medical examination device, and a second deployed position defined by said leg pad adjacent to said seat cushion of said medical examination device.

19. The leg support assembly of claim 18, wherein said slide mechanism further comprising a locking lever movably attached to said leg pad and movable between a locked position and an unlocked position, a locking member configured to restrain said locking lever in said locked position, and a biasing member connected to and biasing said locking lever toward said locking member.

20. The leg support assembly of claim 19, wherein said locking member is perpendicular to said locking lever.

21. The leg support assembly of claim 19, wherein said locking lever further comprises at least one notch dimensioned to receive at least a portion of said locking member therein in said locked position.

22. The leg support assembly of claim 21, wherein said locking lever further comprises a plurality of notches spaced apart at preselected distances along said locking lever, each of said plurality of notches defining a different one of said locked positions each defined by said leg pad spaced apart by a different said predetermined distance from said seat cushion.

23. The leg support assembly of claim 19, wherein said slide mechanism further comprises a support member dimensioned to receive at least a portion of said locking lever in said unlocked position.

24. The leg support assembly of claim 23, wherein said support member is located opposite of said biasing member.

25. The leg support assembly of claim 23, wherein said support member further comprises a protrusion extending therefrom in the direction of said leg pad, said protrusion configured to support said locking lever in said locked and unlocked positions.

26. The leg support assembly of claim 1, further comprising a plurality of tracks fixed in spaced relation to one another, each of said tracks having one of said horizontal section, said inclined section, and said detent.

27. The leg support assembly of claim 1, wherein said frame further comprises a set of said first guide members and a set of said second guide members extending from said frame, said set of said first guide members positioned closer to said first end and said set of said second guide members positioned closer to said second end.

28. The leg support assembly of claim 1, wherein said stowed position is further defined by said leg pad disposed at an angle relative to said horizontal section of said track.

* * * * *